US011959218B2

(12) United States Patent
Hong et al.

(10) Patent No.: US 11,959,218 B2
(45) **Date of Patent: *Apr. 16, 2024**

(54) LAUNDRY MACHINE HAVING INDUCTION HEATER AND CONTROL METHOD THEREOF

(71) Applicant: LG Electronics Inc., Seoul (KR)

(72) Inventors: Sangwook Hong, Seoul (KR); Woore Kim, Seoul (KR); Beomjun Kim, Seoul (KR); Hyunwoo Noh, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/825,693

(22) Filed: May 26, 2022

(65) Prior Publication Data

US 2022/0290353 A1 Sep. 15, 2022

Related U.S. Application Data

(63) Continuation of application No. 16/727,528, filed on Dec. 26, 2019, now Pat. No. 11,359,324.

(30) Foreign Application Priority Data

Dec. 26, 2018 (KR) ..... 10-2018-0169654

(51) Int. Cl.
*D06F 39/00* (2020.01)
*D06F 33/00* (2020.01)
(Continued)

(52) U.S. Cl.
CPC ..... *D06F 39/008* (2013.01); *D06F 33/00* (2013.01); *D06F 34/14* (2020.02); *D06F 39/04* (2013.01); *D06F 39/088* (2013.01); *D06F 37/30* (2013.01)

(58) Field of Classification Search
CPC ..... D06F 21/04; D06F 25/00; D06F 27/00; D06F 33/65; D06F 34/14; D06F 39/008; D06F 39/04
See application file for complete search history.

(56) References Cited

U.S. PATENT DOCUMENTS 3,358,302 A * 12/1967 Candor ..... D06F 58/02 68/19.2
2005/0034490 A1* 2/2005 Oh ..... D06F 39/04 68/5 R (Continued)

FOREIGN PATENT DOCUMENTS

CN 103147257 6/2013
DE 102016110883 11/2017

(Continued)

OTHER PUBLICATIONS

Machine translation of EP-3246454-A1. (Year: 2017).*

(Continued)

*Primary Examiner* — Joseph L. Perrin
(74) *Attorney, Agent, or Firm* — Fish & Richardson P.C.

(57) ABSTRACT

Disclosed herein is a laundry machine. More particularly, a laundry machine for generating steam by an induction heater and a control method thereof are disclosed. According to an embodiment of the present disclosure, provided is a method of controlling a laundry machine including a tub, a drum rotatably arranged in the tub to accommodate an object and provided with a through hole on an outer circumferential surface thereof, and an induction heater provided to the tub, and configured to perform a steam operation. The steam operation may include heating a heating surface of the drum facing the induction heater by driving the induction heater, spraying, through a spray nozzle, water toward the heating surface heated in the heating operation, and rotating the (Continued)

drum such that the steam is introduced into the drum through the through hole in a space between the tub and the drum.

13 Claims, 14 Drawing Sheets

(51) Int. Cl.

| | |
|---|---|
| ***D06F 34/14*** | (2020.01) |
| ***D06F 39/04*** | (2006.01) |
| ***D06F 39/08*** | (2006.01) |
| *D06F 37/30* | (2020.01) |

(56) References Cited

U.S. PATENT DOCUMENTS

| | | | | |
|---|---|---|---|---|
| 2010/0263137 | A1* | 10/2010 | Block | D06F 39/04 68/5 R |
| 2011/0062145 | A1* | 3/2011 | Yang | D06F 58/26 219/538 |
| 2012/0180534 | A1* | 7/2012 | Cho | D06F 35/006 68/18 R |
| 2015/0033478 | A1* | 2/2015 | Im | D06F 21/04 8/137 |
| 2020/0048813 | A1* | 2/2020 | Schaumann | D06F 37/36 |

FOREIGN PATENT DOCUMENTS

| | | | | |
|---|---|---|---|---|
| EP | 2767629 | | 8/2014 | |
| EP | 3246454 | A1 * | 11/2017 | D06F 58/203 |
| KR | 10-2015-0025082 | | 3/2015 | |
| KR | 10-2018-0010271 | | 1/2018 | |
| WO | WO 2006098571 | | 9/2006 | |

OTHER PUBLICATIONS

Office Action in Korean Appln. No. 10-2018-0169654, dated May 14, 2023, 12 pages (with English translation).

Extended European Search Report in European Appln. No. 23168159.4, dated Jul. 28, 2023, 7 pages.

* cited by examiner

LAUNDRY MACHINE HAVING INDUCTION HEATER AND CONTROL METHOD THEREOF

CROSS-REFERENCE TO RELATED APPLICATIONS

This application is a continuation of U.S. application Ser. No. 16/727,528, filed on Dec. 26, 2019, which claims the benefit of Korean Patent Application No. 10-2018-0169654, filed on Dec. 26, 2018. The disclosures of the prior applications are incorporated by reference in their entirety.

TECHNICAL FIELD

The present disclosure relates to a laundry machine, and more particularly, to a laundry machine for generating steam by an induction heater and a control method thereof.

BACKGROUND

The laundry machine includes a tub (outer tub) for storing wash water and a drum (inner tub) rotatably arranged in the tub. Laundry (fabrics) is provided inside the drum, and the fabrics are washed by a detergent and wash water as the drum rotates.

In order to promote the washing effect by promoting activation of the detergent and decomposition of contaminants, hot wash water is supplied into the tub or heated inside the tub. To this end, a lower portion of the inside of the tub is generally recessed downward to form a heater mount portion, a heater is arranged in the heater mount portion. As the heater, a sheath heater is generally adopted.

Recently, laundry machines configured to perform washing, drying and refreshing using steam have been widely deployed.

Thus, during washing, steam is supplied into the drum to increase the ambient temperature inside the drum while using less energy, thereby improving washing performance.

In addition, by supplying steam during drying, wrinkles of clothes may be reduced and the deodorization performance and antistatic performance may be improved.

In addition, by supplying steam to dry clothes, dust, odor and wrinkles may be effectively removed. That is, the refresh performance may be improved.

For these reasons, not only a laundry machine configured to perform only washing but also a laundry machine configured to perform washing and drying or a laundry machine such as a dryer configured to perform only drying generates steam in various forms and supplies the generated steam to the clothes.

A laundry machine configured to perform only washing is basically provided with a sheath heater arranged in the lower part of the tub. Wash water is heated through the heater to perform washing. The sheath heater heats wash water while being submerged in the water.

To generate and supply steam, a separate steam generator may be provided outside the tub. That is, there is a laundry machine that is provided with an external steam generator. This laundry machine may generate high-quality steam freely and supply the generated steam to the laundry inside the drum during the washing and drying processes. However, additional components such as a water supply, a heat generator, a sensor, a safety device, and a discharge part provided in the laundry machine may increase the material cost and restrict the installation structure. In addition, since steam generated by the steam generator may undergo condensation due to the cooling effect while being transferred into the drum through a connection pipe, the steam needs to be heated to a very high temperature in consideration of the condensation. Moreover, high-temperature washing, such as washing with boiled water, is hardly implemented with steam alone. This is because it is not easy to heat the wash water to a high temperature with steam alone. For this reason, it is common to provide a sheath heater that separately heats wash water even for a laundry machine equipped with an external steam generator.

There is a laundry machine having a built-in steam generator for generating steam with a conventional sheath heater unlike the external steam generator. In other words, this laundry machine generates steam using a conventional heater configured to heat wash water. Accordingly, it may lower the material cost as it excludes separate supplemental elements as many as possible. However, this laundry machine merely generates wet steam instead of high-quality steam, thus the operation thereof is limited. In addition, steam is generated by driving the heater after water is supplied efficiently as to make the heater submerging. As a result, the amount of wash water to be heated is relatively large, which may lower energy efficiency. In addition, since a heater protection water level should be maintained and heated water should be prevented from contacting the laundry, the steam generation and provision is limited in terms of time. In particular, since the heater protection water level should be maintained, it is not easy to generate and supply steam during driving of the drum, spin-drying, drying, or driving of a circulation pump. In addition, since it is not easy to generate and supply steam at the washing water level, the time for generating and supplying steam during the washing process is very limited.

A laundry machine having a drying function also has a built-in steam generator or an external steam generator. In this case, however, a separate heater is used to generate hot air. Thus, two heating sources (for wash water heating and steam generation, and hot air generation) or three heating sources (for wash water, steam and hot air generation) are provided, and accordingly the configuration and control logic of the laundry machine are inevitably complicated. Of course, a separate duct or fan is required for the drying function, and accordingly installation of the laundry machine is limited in terms of space.

The applicant of the present application has suggested, through Korean Patent Application No. 10-2018-0123451 (hereinafter referred to as "prior art application"), that the amount of wash water used may be significantly reduced through an induction heater compared to the cases where the conventional tub heater is employed.

It has been suggested that main washing can be performed at a very low water level in the tub without additional water supply when fabrics soaking is completed after water is supplied for washing. In particular, it has been suggested that energy may be saved and performance of fabrics soaking and washing may be improved by heating the drum in the fabrics soaking and main washing.

However, the prior art application does not provide any description involving steam. Therefore, there is a need for a safe laundry machine with an induction heater that takes low manufacturing cost while effectively using steam. In particular, there is a need for a laundry machine capable of addressing the issues of a laundry machine having the conventional steam generator described above.

SUMMARY

Accordingly, the present disclosure is basically directed to substantially obviating one or more problems due to limitations and disadvantages of the conventional laundry machine.

Through one embodiment, the present disclosure is intended to provide a laundry machine that may exclude a heating source involving a sheath heater and employ a heating source involving an induction heater to generate steam and supply the generated steam to the laundry inside the drum, and a control method thereof.

Through one embodiment, the present disclosure is intended to provide a laundry machine capable of minimizing increase in the operating time of the laundry machine due to generation and supply of steam by generating and supplying steam immediately, and a control method thereof.

Through one embodiment, the present disclosure is intended to provide a laundry machine capable of generating steam through a large area to evenly supply steam to the laundry inside a drum, and a control method thereof.

Through one embodiment, the present disclosure is intended to provide a laundry machine for providing high-quality steam by generating steam by spraying water to an outer surface of a heated drum, and a control method thereof. The present disclosure is also intended to provide a laundry machine capable of preventing hot water other than steam from being supplied into the drum through a structural or drum motion, and a control method thereof.

Through one embodiment, the present disclosure is intended to provide a laundry machine capable of generating steam in a space between a tub and a drum and supplying the steam into the drum by driving the drum to exclude a connection hose for supply of steam and allow steam generation and steam supply to be performed substantially simultaneously, and a control method thereof.

Through one embodiment, the present disclosure is intended to provide a laundry machine that employs one induction heater for wash water heating, object drying and steam generation so as to facilitate manufacturing and reduce the manufacturing cost compared to a case where three heaters or two heaters are employed, and a control method thereof.

Through one embodiment, the present disclosure is intended to provide a laundry machine which is provided with a small induction heater for steam generation separately from an induction heater for wash water heating and object drying to save energy, and a control method thereof. In particular, the present disclosure is intended to provide a laundry machine capable of selectively controlling the output powers of two induction heaters through one inverter drive, and a control method thereof.

Through one embodiment, the present disclosure is intended to provide a laundry machine that varies the time for drum motion and water spray between a steam operation in a washing process and a steam operation in a drying or refreshing process to implement optimum steam generation and supply in each process, and a control method thereof.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, provided herein is a method of controlling a laundry machine including a tub, a drum rotatably arranged in the tub to accommodate an object and provided with a through hole on an outer circumferential surface thereof, and an induction heater provided to the tub, the laundry machine being configured to perform a steam operation may be provided. The steam operation may include heating the drum and generating steam by spraying water onto the heated drum. The steam operation may also include supplying the generated steam into the drum.

Specifically, the steam operation may include a heating operation of heating a heating surface of the drum facing the induction heater on an outer surface of the drum by driving the induction heater, a steam generation operation of spraying, through a spray nozzle, water toward the heating surface heated in the heating operation, and a steam supply operation of rotating the drum such that the steam is introduced into the drum through the through hole of the drum in a space between the tub and the drum.

The steam operation may be performed in a washing course of washing the object by supplying water and a detergent to the tub.

The washing course may include a water supply operation of supplying water and the detergent to the tub, a fabrics soaking operation of wetting the object by controlling rotation of the drum and driving of a circulation pump after the water supply operation, and a washing operation of washing the object by excluding an additional water supply and controlling the rotation of the drum and the driving of the circulation pump.

The steam operation may be performed during the washing operation. That is, the steaming operation may be performed in the washing operation in which washing is performed in earnest after completion of the fabrics soaking operation. After termination of the steam operation, the washing operation may be terminated. After the termination of the steam operation, a subsequent washing operation may be performed and then the washing operation may be terminated. After the washing operation is terminated, the washing course may be terminated, and then a rinsing course and a spin-drying course may be performed.

The steam generation operation may be performed after the heating operation is performed for a predetermined time. The heating operation may be an operation of driving the induction heater, and the steam generation operation may be an operation of spraying water.

The heating operation may be continued even during the steam generation operation. That is, the induction heater may be driven to heat the drum even during the spray.

The steam generation operation may be repeatedly performed a plurality of times. That is, a plurality of spray operations may be performed.

The steam supply operation may be performed between the steam generation operations.

When steam is generated by water spray, the steam supply operation may be performed. Then, steam may be generated by water spray again. This process may be repeated in the steam operation.

The heating operation may be performed before each of the plurality of steam generation operations is performed.

The heating operation may be continuously performed between the steam generation operations.

In the heating operation and the steam generation operation, the drum may be stopped to fix the heating surface of the drum.

In the heating operation and the steam generation operation, the drum may be controlled to perform a swing motion to expand the heating surface of the drum in a circumferential direction of the drum. The swing motion may be a motion of repeated switching between forward and reverse rotations of the drum within a range below 180 degrees, in particular, a range of 90 degrees or less.

In the steam supply operation, the drum may be driven in a tumbling motion or a filtration motion, wherein the tumbling motion may be a motion of rise and fall of the object repeated as the drum rotates at 40 to 60 revolutions per minute (RPM), wherein the filtration motion may be a motion of integrated rotation of the drum and the object closely contacting an inner circumferential surface of the drum when the drum rotates at 70 to 120 RPM.

The steam generation operation may be performed in a period in which the drum is stopped to change a rotation direction of the drum in the washing course. Such a stop of the drum may also occur in the washing course, which is independent of steam. Accordingly, steam may be generated and supplied using the conventional drum driving logic without applying a separate drum driving logic for the steam operation.

The steam operation may be performed in a refreshing course for deodorizing the dry object and reducing winkles thereon.

The steam operation may include a heating operation of driving the drum in a tumbling motion and driving the induction heater, and a steam generation and supply operation of spraying water while driving the drum in a filtration motion after the heating operation.

The filtration motion may be continuously performed by accelerating the drum in the tumbling motion, and driving of the induction heater may be continuously maintained.

The steam operation may be performed at a last stage of a drying course for removing moisture from the wet object by heating the drum through the induction heater, to reduce static electricity and wrinkles on the object.

The steam operation may include a heating operation of driving the drum in a filtration motion and driving the induction heater, and a steam generation and supply operation of spraying water while maintaining the filtration motion of the drum after the heating operation.

Therefore, the motion of the drum for steam generation and supply may differ among the courses. This is because the condition of the object, the purpose of the steam and the environment inside the tub may vary depending on the courses.

In another aspect of the present disclosure, a method of controlling a laundry machine including a tub, a drum rotatably arranged in the tub to accommodate an object and provided with a through hole on an outer circumferential surface thereof, and an induction heater provided to the tub may be provided, the laundry machine being configured to perform a steam operation. The steam operation may include a heating operation of heating a heating surface of the drum facing the induction heater on an outer surface of the drum by driving the induction heater, a steam generation operation of spraying, through a spray nozzle, water toward the heating surface heated in the heating operation, and a steam supply operation of rotating the drum such that the steam may be introduced into the drum through the through hole of the drum in a space between the tub and the drum, wherein the heating operation, the steam generation operation, and the steam supply operation are performed sequentially while the drum may be rotating at the same target revolutions per minute (RPM).

For example, during driving of the drum at a tumbling RPM or filtration RPM, water may be sprayed while the induction heater is driven (heating operation) (steam generation operation). Steam generated while driving of the drum is maintained may be supplied into the drum (steam supply operation). This drum motion may be used in the refreshing or drying course. Of course, it may also be used in the washing course. Therefore, even if a separate drum motion for the steam operation is not implemented, only time to spray water may need to be determined. Therefore, the control logic with steam may be simply and easily implemented in the control logic without steam.

In another aspect of the present disclosure, a laundry machine may include a tub, a drum rotatably arranged in the tub to accommodate an object and provided with a through hole on an outer circumferential surface thereof, a steam induction heater provided at a front upper portion of a front wall of the tub or a rear upper portion of the tub and configured to heat a heating surface of an outer surface of the drum, a motor driven to rotate the drum, a spray nozzle configured to spray water onto the heating surface of the drum facing the steam induction heater to generate steam, and a processor configured to rotate the drum such that the steam is introduced into the drum through the through hole of the drum in a space between the tub and the drum.

The heating surface of the drum may be formed on the upper front surface of the front wall of the drum above a front opening of the drum. In addition, the heating surface of the drum may be formed on the upper rear surface of the rear wall of the drum. The position of the heating surface may be determined by the position of the steam induction heater facing the heating surface.

The heating surface of the drum may be formed on an upper portion of a front or rear wall surface of the drum of the outer surface of the drum so as to face the induction heater. This may be particularly intended to minimize the influence of wash water or cooling water on the heating surface of the drum. In addition, in spraying water through the spray nozzle, it may be more preferable to spray water downward than to spray water upward.

The steam induction heater may be configured to be driven for the steam generation. That is, the steam induction heater may be dedicated to the steam generation.

The laundry machine may further include a main induction heater arranged on an upper portion of a cylindrical outer circumferential surface of the tub separately from the steam induction heater and configured to directly heat the heating surface of the drum formed on the outer circumferential surface of the drum to heat water or the object inside the tub.

A capacity and size of the main induction heater may be larger than a capacity and size of the steam induction heater. For steam generation, only a small part of the drum needs to be heated. On the other hand, when the wash water and the object are to be heated, a wide area may be heated. Therefore, the main induction heater and the steam induction heater may be installed at different positions due to the difference in capacity and the heating target.

The laundry machine may further include a single inverter drive configured to control output power of the steam induction heater and the main induction heater, and a switch configured to selectively connect the steam induction heater and the main induction heater with the single inverter drive.

The processor may control the switch to selectively drive one of the induction heater and the main induction heater through the single inverter drive.

The laundry machine may further include a water supply valve configured to supply water to the spray nozzle from an external water supply source or a pump configured to supply stored water to the spray nozzle.

The spray nozzle may include a swirler configured to generate a rotational speed component in water flowing into the spray nozzle to perform annular droplet spray, a diffusion region extending in a longitudinal direction of the spray nozzle to extend a spray region after a swirl region, an outlet through which water is sprayed to the outside of the spray nozzle after the diffusion region, and a diffuser configured to surround the outlet and expand radially outward to form a spray angle.

The spray nozzle may be arranged to supply water in an oblique direction toward the surface of the drum facing the nozzle from the outside of a horizontal space of the surface of the drum facing the nozzle. In particular, the spray nozzle may be configured to supply water downward. To this end, the induction heater may be provided on an upper portion of the tub, and the spray nozzle may be mounted on an upper portion of the tub above the induction heater.

The processor may perform a control operation to perform a steam operation of generating steam and supplying the stem into the drum in a washing course of washing the object by supplying water and a detergent to the tub.

The processor may perform a control operation to perform the steam operation of generating the steam and supplying the steam into the drum in a refreshing course for deodorizing the dry object and reducing winkles thereon.

The processor may perform a control operation to perform the steam operation of generating the steam and supplying the steam into the drum in at a last stage of a drying course of drying the object in order to reduce wrinkles on the object and remove static electricity therefrom.

The condition of the object, the purpose of steam and the environment inside the tub differ between the washing course and the drying or refreshing course. Therefore, driving of the drum and the drum motion at the time of steam generation and steam supply differ between the courses.

In another aspect of the present disclosure, a laundry machine may include a tub, a drum rotatably arranged in the tub to accommodate an object and provided with a through hole on an outer circumferential surface thereof, an induction heater provided in the tub and configured to heat a heating surface of the drum facing the induction heater, a motor driven to rotate the drum, a spray nozzle configured to spray water onto the heating surface of the drum facing the induction heater to generate steam, and a processor configured to rotate the drum such that the steam is introduced into the drum through the through hole of the drum in a space between the tub and the drum.

The water supplied to the spray nozzle may be water supplied from an external water supply source or water stored in the laundry machine. In order to supply such water to the spray nozzle, the laundry machine may further include a water supply valve configured to supply water to the spray nozzle from the external water supply source or a pump configured to supply the stored water to the spray nozzle.

The stored water may be water stored of water generated during washing or drying in the laundry machine, or may be water stored in a lower portion of the tub.

The spray nozzle may be configured to perform annular droplet spray. That is, it may be configured to evenly spray water over a wide area in a droplet form.

To this end, the spray nozzle may include a swirling region, an inner diffusion region, a discharge region, and an outer diffusion region.

Specifically, the swirling region may be formed by a swirler configured to generate a rotational speed component in the water introduced into the spray nozzle. The swirler may be arranged in the spray nozzle to form the swirling region in the spray nozzle.

The diffusion region extending in the longitudinal direction of the spray nozzle is provided to expand the spray region after the swirling region. The diffusion region may be provided inside the spray nozzle, and may be a region in which the rotational speed component of the water generated in the swirling region disappears.

An outlet through which water is sprayed to the outside of the spray nozzle is formed after the diffusion region. A portion having a narrowed diameter is formed between the diffusion region and the outlet. Thus, the portion in which the diameter is narrowed (the contracting tube portion) and the outlet may be referred to as the discharge region. The discharge region may be formed inside the spray nozzle.

A diffuser configured to surround the outlet and expand radially outward to form a spray angle may be provided. The diffuser may be formed as an expansion tube portion. Accordingly, the diffusion region outside the spray nozzle may be formed through the diffuser.

The swirling angle of the swirler may be 50 to 70 degrees, the length of the diffusion region may be 4 to 8 mm, and the inner diameter of the outlet may be 3.5 to 4.5 mm. Thereby, flow resistance by the spray nozzle may be minimized and spray performance for spraying water in the form of droplets evenly on the targeted heating surface may be satisfied.

The spray nozzle may be arranged outside of the vertical or horizontal space of the heating surface of the drum to supply water toward the heating surface in an oblique direction. This is intended to prevent the water discharged from the spray nozzle from reaching the heating surface when the water pressure is very weak.

The spray nozzle may be arranged to supply water downward. This is intended to allow water to be sprayed onto the heating surface through the spray nozzle even when the water pressure is somewhat weak. It is also intended to minimize the sprayed water that is introduced into the through-hole of the drum without reaching the heating surface.

The processor may perform a control operation to perform a steam operation of generating steam and supplying the stem into the drum in a washing course of washing the object by supplying water and a detergent to the tub. In the washing course, the atmosphere temperature inside the drum and the tub may be increased by steam. In other words, the atmosphere temperature may be effectively increased through less energy. Thereby, the detergent decomposition effect and the contaminant decomposition effect may be enhanced, and accordingly very effective washing performance may be secured.

A circulation pump may be configured to pump water in a lower portion of the tub and resupply the pumped water to the lower portion of the tub from an inner upper portion of the tub.

The washing course may include a water supply operation of supplying water and the detergent to the tub, a fabrics soaking operation of wetting the object by controlling rotation of the drum and driving of the circulation pump after the water supply operation, and a washing operation (main washing operation) of washing the object by excluding an additional water supply and controlling the rotation of the drum and the driving of the circulation pump after completion of the fabrics soaking operation.

The processor may perform a control operation to perform the steam operation during the washing operation.

The processor may drive the induction heater for a predetermined time (preheating) for steam generation and then control the water to be sprayed through the spray nozzle (steam generation). That is, steam may be generated by spraying water on the preheated heating surface. Therefore, high-quality steam may be generated.

The processor may control driving of the induction heater to be continued even during the spraying. Thus, high-quality steam may be generated both at the beginning and end of spray.

The processor may perform a control operation to repeatedly perform the spraying of water through the spray nozzle a plurality of times. That is, one spray time may be preset, and steam generation, that is, spray may be performed multiple times in order to generate and supply a predetermined amount of steam. The longer the single spray time, the lower the temperature of the heating surface at the end of the spray may be. Thus, in order to consistently generate high-quality steam, one spray time may be set between about 1 second and 3 seconds.

The processor may control the drum to rotate such that the steam is supplied into the drum in a period between the spraying and spraying. That is, the drum may be rotated such that the steam generated in the space between the tub and the drum is smoothly supplied into the drum.

The processor may control the preheating to be performed every time the spraying is performed. Accordingly, high-quality steam may be generated not only through the initial spray but also through intermediate sprays and the last spray. To this end, the processor may control driving of the induction heater to be continued between the spraying and spraying. In one example, in the steam operation, the driving of the induction heater may be continued, spraying may be performed a plurality of times. In one example, the driving of the induction heater may be continued throughout the steam operation, and the steam operation may be terminated after a plurality of sprays is performed at predetermined intervals for a predetermined time.

In the preheating and steam generation, the processor may control the drum to be stopped to fix the heating surface of the drum. Since the heating surface is fixed, the heating effect of the heating surface may be further enhanced. In addition, when water is sprayed onto the fixed heating surface, high-quality steam may be generated.

In the preheating and steam generation, the processor may control the drum to perform a swing motion such that the heating surface of the drum expands in a circumferential direction of the drum. The swing motion may be a motion of repeated switching between forward and reverse rotations of the drum within a range below 180 degrees, and more preferably, within a range below about 90 degrees.

The heating surface may be located on top of the drum. Thus, in the swing motion, the heating surface, specifically the drum inner surface corresponding to the heating surface may not contact the object. Accordingly, when the heating surface is expandable through the swing motion, a large heating surface may be effectively heated. Of course, the temperature rise will be smaller than when the heating surface is fixed.

High-quality steam may be generated through this swing motion.

The processor may control the drum to perform a tumbling motion or a filtration motion after the steam generation.

The tumbling motion may be a motion of rise and fall of the object repeated as the drum rotates at 40 to 60 revolutions per minute (RPM), wherein the filtration motion may be a motion of integrated rotation of the drum and the object closely contacting an inner circumferential surface of the drum when the drum rotates at 70 to 120 RPM.

After the steam generation, the drum may be rotated a plurality of times to generate air flow inside the tub. Thereby, steam generated in the space between the tub and the drum may be introduced into the drum. In particular, in the filtration motion, the object closely contacts and closes the through-hole in the outer circumferential surface of the drum. Therefore, the steam may pass through the object through the through-hole. Thereby, the steam supply effect may be further enhanced.

The processor may control the steam generation to be performed in a period in which the drum is stopped to change a rotation direction of the drum in the washing course. That is, separate drum control may not be performed to generate steam. In other words, steam may be generated using the drum driving logic for the washing course. In other words, as described above, the drum driving logic may not separately provide a swing motion or a drum stop period for steam generation. This may simplify the control logic and reduce the additional time required for the washing course due to steam generation.

The processor may perform a control operation to perform a steam operation of generating steam and supplying the steam to the drum in a refreshing process (course) for deodorizing the dry object and reducing winkles thereon.

The processor may control the induction heater to be driven while controlling the drum in a tumbling motion, and then control water to be sprayed while controlling the drum in a filtration motion.

The processor may control acceleration to be continuously performed from the tumbling motion to the filtration motion and control driving of the induction heater to be continuously maintained.

Therefore, the drum motion in steam generation in the refreshing process (course) may be the same as the drum motion in steam supply. For example, steam generated by maintaining the drum motion for the steam generation may be supplied into the drum.

In the refreshing process (course), the dry object is refreshed, and accordingly it may not be preferable to supply hot water, not steam, directly to the dry object inside the drum. Thus, the drum may be heated while being rotated, and water may be sprayed onto the heating surface while the rotation of the drum is maintained. Even after the spraying, the rotation of the drum may be maintained. Thereby, hot water, not steam, may be significantly prevented from flowing into the drum.

In the refreshing process (course), the dry object is refreshed, and there is very little moisture inside the tub or drum. Accordingly, there is no object that absorbs much heat during drum heating. Therefore, even if the heating surface is heated during rotation of the drum, the temperature of the heating surface may rise to an appropriate temperature for steam generation.

The processor may perform a control operation to perform a steam operation of generating the steam and supplying the steam into the drum at a last stage of a drying course for removing moisture from the wet object by heating the drum through the induction heater, to reduce static electricity and wrinkles on the object.

The processor may perform a control operation to drive the induction heater and cause water to be sprayed in a filtration motion of the drum.

The steam operation in the drying process (course) may be the same or similar to the steam operation in the refreshing process (course). This is because at the last stage of the drying course, steam is supplied when the water content is about 15% or less or less than 10%. In the filtration motion, steam may pass through the object, thereby maximizing the effect of reducing wrinkles and static electricity.

In the above-described embodiments, the induction heater may be arranged on an upper portion of a cylindrical outer circumferential surface of the tub, and the heating surface of the drum may be formed on an upper portion of the outer circumferential surface of the drum to face the induction heater. The induction heater may be provided only for steam generation. For example, a sheath heater may be provided for heating of wash water as in the conventional cases. However, the induction heater may be configured to directly heat the drum to heat water or the object inside the tub. The number of heaters may be reduced and thus wash water heating and steam generation may be performed through one heater. In addition, with the induction heater, heating of the object as well as wash water may be performed, and thus a heater function for drying may be added.

In the above-described embodiments, the induction heater may be arranged on an upper portion of a front wall or rear wall of the tub, and the heating surface of the drum may be formed on an upper portion of a front wall or rear wall of the drum to face the induction heater. The induction heater may be provided only for steam generation. For example, a sheath heater may be provided for heating of wash water as in the conventional cases. However, a separate main induction heater may be provided for heating of wash water. In this case, heating of the object as well as wash water may be performed, and thus a heater function for drying may be added. The main induction heater may be arranged on an upper portion of a cylindrical outer circumferential surface of the tub separately from the induction heater and configured to directly heat the heating surface of the drum formed on the outer circumferential surface of the drum to heat water or the object inside the tub.

The laundry machine further may include a single inverter drive configured to control output power of the induction heater and the main induction heater, and a switch configured to selectively connect the induction heater and the main induction heater with the single inverter drive. That is, the two induction heaters may be driven, selectively using one inverter drive. The processor may control the switch to selectively drive one of the induction heater and the main induction heater through the single inverter drive.

Accordingly, the manufacturing costs may be reduced and the control logic may be simplified.

In another aspect of the present disclosure, a laundry machine may include a cabinet defining an outer shape thereof, a cylindrical tub provided in the cabinet and having a front opening, a cylindrical drum configured to accommodate an object and rotatably provided in the tub, the drum being provided with a plurality of through holes formed on an outer circumferential surface thereof and a front opening, an induction coil mounted to the tub configured to heat a heating surface of the drum facing the induction coil on an outer surface of the drum, a motor driven to rotate the drum, a spray nozzle configured to spray water onto the heating surface of the drum to generate steam, a door configured to selectively open and close an introduction port of the cabinet, a gasket arranged between the introduction port of the cabinet and the front opening of the tub, and a processor configured to rotate the drum such that the steam is introduced into the drum through the through holes of the drum in a space between the tub and the drum.

When the door is closed, the space defined by the door, the gasket and the tub may have a sealed space substantially isolated from the outside, and the drum is arranged to be rotatable in the sealed space. When the introduction port of the cabinet is opened, the front opening of the drum may be open to the outside, and thus a user may be allowed to put or remove an object through the front opening.

Steam generated in the space between the inner circumferential surface of the tub and the outer circumferential surface of the drum, in particular, the upper space provided with the heating surface of the drum, may flow into the drum not only through the plurality of through holes formed in the outer circumferential surface of the drum but also through the front opening of the drum.

In particular, in the filtration motion, one surface of the object in close contact with the inner circumferential surface of the drum may collide with the steam introduced through the through holes, and the other surface of the object may collide with the steam introduced through the front opening of the drum. Therefore, the steam may be evenly supplied to the object as well as the inner space of the drum and the inner space of the tub.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Reference will now be made in detail to the preferred embodiments of the present disclosure, examples of which are illustrated in the accompanying drawings. Wherever possible, the same reference numbers will be used throughout the drawings to refer to the same or like parts.

Figure 1:
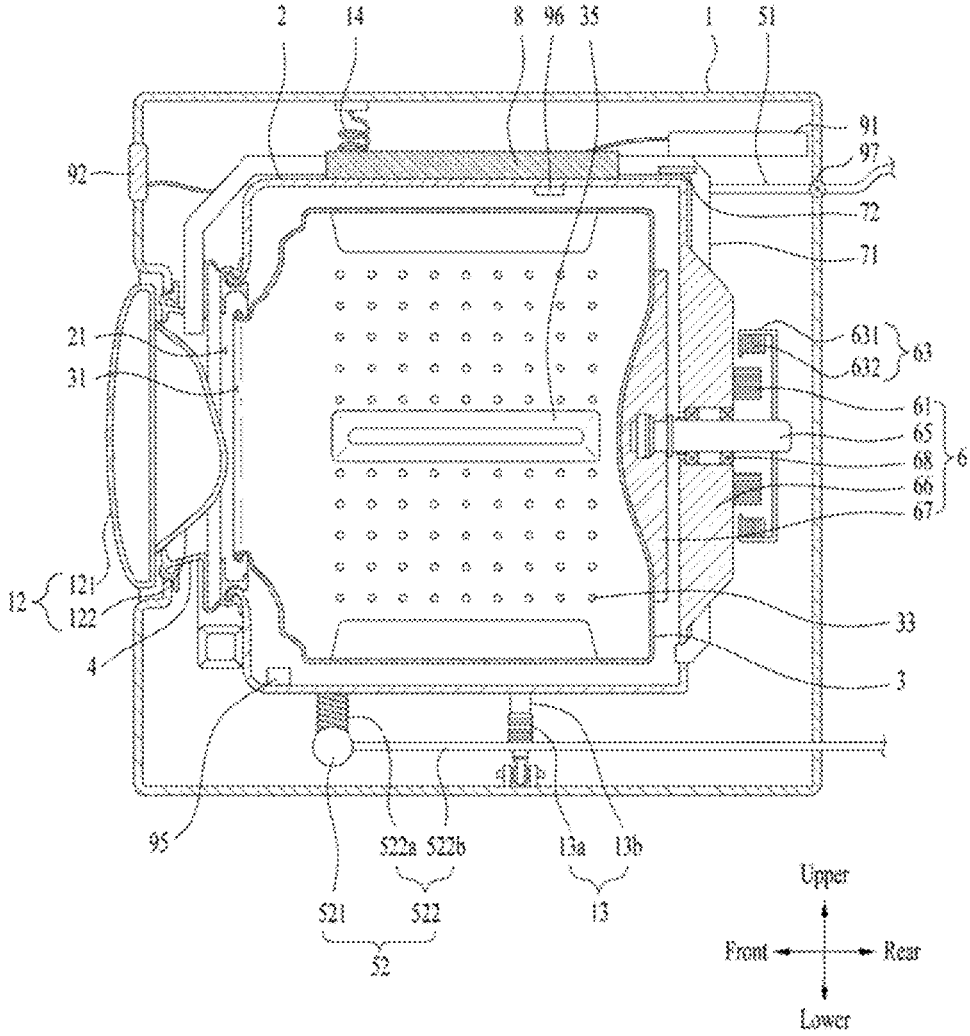
FIG. 1 shows an example of a laundry machine according to an embodiment of the present disclosure.

Hereinafter, a laundry machine according to an embodiment of the present disclosure will be described with reference to FIG. 1.

In the following embodiments, specific components may be shown or described as exaggerated or reduced for convenience of description. This is intended to facilitate understanding of the present disclosure. In addition, except for the features related to steam, the laundry machine according to the embodiment may be similar to the laundry machine disclosed in the prior art patent document mentioned above. Of course, the control method of the laundry machine may also be similar to the method disclosed in the prior art patent document.

Accordingly, the present disclosure is not limited to the embodiments disclosed below. It will be apparent to those skilled in the art that various modifications and variations can be made in the present disclosure without departing from the spirit and scope of the disclosure.

A laundry machine according to an embodiment of the present disclosure may include a cabinet 1 defining an outer appearance thereof, a tub 2 arranged in the cabinet, and a drum 3 rotatably arranged in the tub 2 to accommodate an object (for example, an object to be washed, an object to be dried, or an object to be refreshed). For example, when clothing is to be washed by wash water, it may be referred to as an object to be washed. When wet clothing is dried using heat, it may be referred to as an object to be dried. When dry clothing is refreshed using hot air, cold air or steam, it may be referred to as an object to be refreshed. Therefore, washing, drying or refreshing of clothing may be performed through the drum 3 of the laundry machine.

The cabinet 1 may include a cabinet opening provided at the front of the cabinet 1 to allow an object to enter and exit. The cabinet 1 may be provided with a door 12 rotatably mounted to the cabinet to open and close the introduction port (cabinet opening).

The door 12 opens and closes the cabinet opening, thereby opening and closing the front opening of the tub. Therefore, the inside of the tub may be substantially sealed by closing the door.

The door 12 may include an annular door frame 121 and a see-through window 122 arranged at the center of the door frame.

Here, regarding definition of the directions to help understand the detailed structure of the laundry machine which is described below, the side on which the center of the cabinet 1 faces the door 12 may be defined as a front side.

In addition, the opposite side of the side facing the door 12 may be defined as a rear side, and the right and left sides may be naturally defined depending on the front and rear sides defined above.

The tub 2 is formed in a cylindrical shape whose longitudinal axis is parallel to the bottom surface of the cabinet or maintained at 0° to 30° with respect to the bottom surface of the cabinet to define a space to store water. The tub 2 is provided with a tub opening 21 at the front thereof to communicate with the introduction port.

The tub 2 may be fixed to the bottom surface of the cabinet 1 by a lower support part 13, which includes a support bar 13*a* and a damper 13*b* connected to the support bar 13*a*. Accordingly, vibration generated in the tub 2 by rotation of the drum 3 may be attenuated.

In addition, an elastic support 14 fixed to the top surface of the cabinet 1 may be connected to the top surface of the tub 2. The elastic support 14 may serve to attenuate vibration generated in the tub 2 and transmitted to the cabinet 1.

The drum 3 may be formed in a cylindrical shape whose longitudinal axis is parallel to the bottom surface of the cabinet maintained at 0° to 30° with respect to the bottom surface of the cabinet to accommodate an object, and be provided at the front thereof with a drum opening communicating with the tub opening 21. The angles formed by the central axes of the tub 2 and the drum 3 with respect to the bottom surface may be the same.

In addition, the drum 3 may include a plurality of penetrated holes or through holes 33 formed through the outer circumferential surface of the drum. Air and wash water may flow between the drum 3 and the tub 2 through the through holes 33.

The inner circumferential surface of the drum 3 may be provided with a lifter 35 for stirring the object when the drum is rotated. The drum 3 may be rotated by a drive 6 arranged on the rear of the tub 2.

The drive 6 may include a stator 61 fixed to the rear surface of the tub 2, a rotor 63 configured to rotate by electromagnetic interaction with the stator, and a rotary shaft 65 arranged through the rear surface of the tub 2 to connect the drum 3 and the rotor 63.

The stator 61 may be fixed to a rear surface of the bearing housing 66, which is arranged on the rear surface of the tub 2. The rotor 63 may include a rotor magnet 632 arranged on a radially outer side of the stator, and a rotor housing 631 connecting the rotor magnet 632 and the rotary shaft 65.

The bearing housing 66 may be provided therein with a plurality of bearings 68 supporting the rotary shaft 65.

In addition, a spider 67 may be arranged on the rear surface of the drum 3 to easily transmit the rotational force of the rotor 63 to the drum 3. The rotary shaft 65 for transmitting the rotational power of the rotor 63 may be fixed to the spider 67.

According to an embodiment of the present disclosure, the laundry machine may further include a water supply hose 51 configured to receive water from the outside. The water supply hose 51 defines a flow passage for supplying water to the tub 2.

In addition, a gasket 4 may be arranged between the introduction port of the cabinet 1 and the tub opening 21. The gasket 4 serves to prevent water inside the tub 2 from leaking into the cabinet 1 and vibration of the tub 2 from being transmitted to the cabinet 1.

According to an embodiment of the present disclosure, the laundry machine may further include a drainage part 52 configured to discharge the water from the tub 2 to the outside of the cabinet 1.

The drainage part 52 may include a drain pipe 522 defining a drain flow passage through which water moves from the tub 2, and a drain pump 521 configured to generate a pressure difference in the drain pipe 522 to drain water through the drain pipe 522.

More specifically, the drain pipe 522 may include a first drain pipe 522*a* connecting the bottom surface of the tub 2 and the drain pump 521, and a second drain pipe 522*a* having one end connected to the drain pump 521 to form a flow passage through which water moves to the outside of the cabinet 1.

According to an embodiment of the present disclosure, the laundry machine may further include a heating part 8 configured to inductively heat the drum 3.

The heating part 8 is mounted on the circumferential surface of the tub 2 and inductively heats the circumferential surface of the drum 3 through a magnetic field generated by applying current to a coil formed by winding a wire. Thus, the heating part may be referred to as an induction heater or an induction coil. When the induction heater is driven, the outer circumferential surface of the drum facing the induction heater 8 may be heated to reach a very high temperature within a very short time.

The heating part 8 may be controlled by a controller 9 fixed to the cabinet 1. The controller 9 controls the temperature inside the tub by controlling the driving of the heating part 8. The controller 9 may include a processor configured to control driving of the laundry machine, and may include an inverter processor or an inverter drive 91 configured to control the heating part. The controller may control driving of the laundry machine and driving of the heating part 8 through one processor.

However, in order to ensure control efficiency and prevent overload of the processors, a processor configured to control driving of the laundry machine and a processor configured to control the heating part may be provided separately and communicatively connected to each other.

A temperature sensor 95 may be provided inside the tub 2. The temperature sensor 95 may be connected to the controller 9 to transmit temperature information about the inside of the tub 2 to the controller 9. In particular, it may be configured to sense the temperature of wash water or humid air. Thus, the temperature sensor may be referred to as a wash water temperature sensor.

The temperature sensor 95 may be arranged near the inner bottom of the tub. Thus, the temperature sensor 95 may be located at a lower position than the lowest end of the drum. While FIG. 1 shows that the temperature sensor 95 is arranged to contact the bottom surface of the tub, the temperature sensor may be arranged spaced apart from the bottom surface by a predetermined distance. This is intended to ensure that the temperature sensor accurately measures the temperature of wash water or air while being surrounded by the wash water or air. The temperature sensor 95 may be mounted by being vertically arranged through the tub, or by being horizontally arranged through the tub from the front toward the back. That is, it may be mounted through the front surface (the surface provided with the tub opening) of the tub, not the circumferential surface of the tub.

Therefore, when the laundry machine heats wash water through the induction heater 8, it may be sensed through a temperature sensor whether the wash water has reached a target temperature through heating. Driving of the induction heater may be controlled based on the sensing result from the temperature sensor.

In addition, when all the wash water is drained, the temperature sensor 95 may sense the temperature of air. Since the remaining wash water or cooled water is collected at the bottom of the tub, the temperature sensor 95 senses the temperature of humid air.

According to an embodiment of the present disclosure, the laundry machine may include a drying temperature sensor 96. The drying temperature sensor 96 may be arranged at a different position from the above-described temperature sensor 95 to measure the temperature of another object. The drying temperature sensor 996 may sense the temperature of the air heated through the induction heater 8, that is, a drying temperature. Therefore, whether the air has been heated up to the target temperature may be sensed through the temperature sensor. Driving of the induction heater may be controlled based on the sensing result from the drying temperature sensor.

The drying temperature sensor 96 may be positioned at an upper portion of the tub 2 and arranged near the induction heater 8. That is, it may be arranged on the inner surface of the tub 2 outside the projection surface of the induction heater 8 so as to sense the temperature of the outer circumferential surface of the drum 3 facing the drying temperature sensor. The temperature sensor 95 may be configured to sense the temperature of the surrounding water or air, and the drying temperature sensor 96 may be configured to sense the temperature of the drum or the temperature of dry air around the drum.

Since the drum 3 is configured to rotate, the temperature of the outer circumferential surface of the drum may be indirectly sensed by sensing the temperature of air in the vicinity of the outer circumferential surface of the drum 30.

The temperature sensor 95 may be provided to determine whether to continue to drive the induction heater until the target temperature is reached or to vary the output power of the induction heater. The drying temperature sensor 96 may be provided to determine whether the drum is overheated. When it is determined that the drum is overheated, driving of the induction heater may be forcibly stopped.

According to an embodiment, the laundry machine may have a drying function. In this case, the laundry machine according to the embodiment may be referred to as a drying and washing machine. To this end, the laundry machine may further include a fan 72 configured to blow air into the tub 2 and a duct 71 in which the fan 72 is installed. Of course, even when such elements are not additionally provided, the drying function may be performed. That is, cooling of the air may be performed on the inner circumferential surface of the tub, and moisture may be condensed and discharged. In other words, even when circulation of air does not occur, drying may be performed by condensing moisture. Cooling water may be supplied into the tub to more effectively perform moisture condensation to enhance drying efficiency. Higher efficiency may be obtained when the surface area of the tub that contacts the cooling water, that is, the surface area of air that contacts the cooling water is increased. To this end, the cooling water may be supplied while being widely spread on the rear surface, one side or both sides of the tub. As the cooling water is supplied, the cooling water may flow along the inner surface of the tub and thus may be prevented from flowing into the drum. Therefore, the duct or the fan for drying may be omitted, and thus the laundry machine may be manufactured very easily.

In this case, it is not necessary to provide a separate heater for drying. That is, drying may be performed using the induction heater 8. In other words, wash water heating in washing, object heating in spin-drying, and object heating in drying may all be performed with one induction heater.

When the drum 3 is driven and the induction heater 8 is driven, substantially the entire outer circumferential surface of the drum may be heated. As the heated drum performs heat exchange with the wet laundry, the laundry is heated. Of course, the air inside the drum may also be heated. Therefore, when the air is supplied into the drum 3, it may evaporate moisture through heat exchange and then be discharged from the drum 3. That is, air may be circulated between the duct 71 and the drum 3. Of course, the fan 72 may be driven to circulate the air.

The supply position and discharge position of the air may be determined to allow heated air to be evenly supplied to the object to be dried and allow humid air to be smoothly discharged. For this purpose, air may be supplied through a front upper portion of the drum 3 and be discharged through a rear lower portion of the drum 3, i.e., a rear lower portion of the tub.

The air discharged through the rear lower portion of the tub flows along the duct 71. Moisture in the humid air may be condensed by the condensed water supplied into the duct 71 through the condensed water flow passage in the duct 71. When moisture is condensed in the humid air, the humid air is transformed into low-temperature dry air. The low-temperature dry air may flow along the duct 71 and then be supplied back into the drum 3.

The temperature of the heated air may be lower than the temperature of air heated by a general heater dryer because the air is not directly heated. Accordingly, damage or deformation of the clothing, which may be caused by high-temperature heat, may be prevented. Of course, the clothing may be overheated due to the high temperature of the drum.

However, as described above, the induction heater is driven along with driving of the drum, the clothing repeats rise and fall (tumbling motion) as the drum is driven, and the heating position of the drum is not the bottom of the drum, but the top of the drum. Accordingly, overheating of the object may be effectively prevented. In addition, in the spin motion or the filtration motion in which the drum and the object rotate together, the rotation speed of the drum is higher than the rotation speed of the tumbling motion, and therefore overheating of the object may be effectively prevented. In particular, the induction heater may be controlled to be driven only while the drum is rotating, and the drum is repeatedly rotated and stopped. Accordingly, overheating of the object may be more effectively prevented.

A control panel 92 may be provided on the front surface or top surface of the laundry machine. The control panel may be configured for a user interface. The user may provide various inputs, and various kinds of information may be displayed. That is, the control panel 92 may include an operation part to be operated by the user and a display configured to display information for the user.

Figure 2:
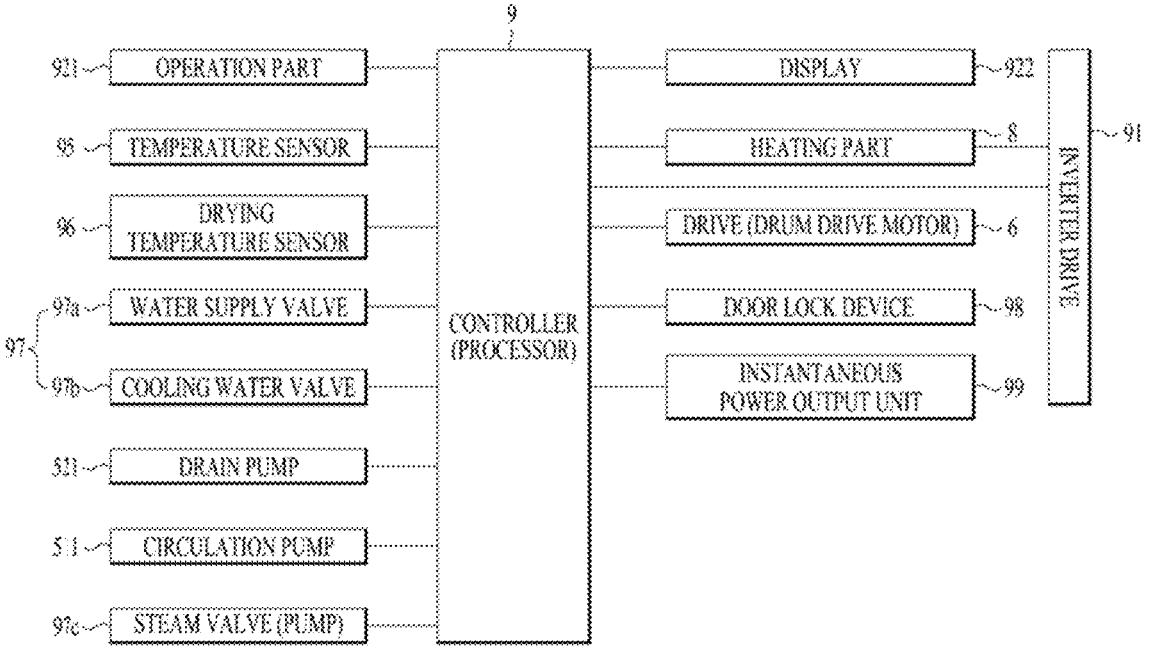
FIG. 2 shows control elements of a laundry machine according to an embodiment of the present disclosure.

FIG. 2 shows a system block diagram of a laundry machine according to an embodiment of the present disclosure.

The controller 9 may control driving of the heating part, that is, the induction heater 8 through the temperature sensor 95 and the drying temperature sensor 96. The controller 9 may control driving of the drive 6 for driving the drum through a motor and driving of various kinds of sensors and hardware. The controller 9 may control various valves and pumps for water supply, drainage, and cooling water supply, and control a fan.

In particular, according to the embodiment, a cooling water valve 97*b* may be provided to change high-temperature humid air/environment into low-temperature dry air/environment. The cooling water valve 97*b* allows cool water to be supplied into the tub or the duct to cool the air to condense moisture in the air. The cooling water valve is provided to supply cooling water from an external water supply source when the cooling water is needed.

In addition, according to this embodiment, since the washing function should be basically performed, a water supply valve 97*a* may be provided to supply wash water from an external water supply source into the tub. Water at room temperature may be basically supplied into the tub through the water supply valve 97*a* such that washing is performed with wash water. Of course, a water supply valve may be additionally provided to supply hot water.

In this embodiment, a steam valve 97*c* for generating steam may be further provided. It may be a valve for supplying water needed for steam generation. Like the water supply valve 97*a*, the steam valve 97*c* may be provided to supply water from an external water supply source. Of course, it may be provided to supply hot water as well as cool water. However, since the water supply time for steam is different from the water supply time for washing, the water supply valve 97*a* and the steam valve 97*c* may be provided separately. Of course, in the case where one valve such as a three-way valve is provided to selectively form various flow passages, the functions of the water supply valve and the steam valve may be implemented by one valve.

Water supply for steam generation may be performed by pumping water stored in the laundry machine, not the external water supply. In this case, the corresponding element may be a steam pump, not the steam valve for steam generation. It may be configured to pump and supply water for steam generation.

This embodiment may include a circulation pump 511 configured to resupply wash water stored in the lower portion of the tub from the upper portion to the lower portion of the inside of the tub. As described above, in performing washing through the induction heater, the water level inside the tub may be lower than the lowest end of the drum. Thus, when the drum rotates, the lower end of the drum is not immersed in wash water, and therefore wash water is not supplied into the drum. Therefore, the circulation pump may be driven to resupply the wash water stored in the lower portion of the tub into the drum.

The circulation pump 511 may be configured not only to resupply wash water but also to supply water for steam generation.

During spin-drying and/or supply of cooling water, a drain pump 521 may be driven periodically or intermittently.

According to this embodiment, a door lock device 98 may be provided. The door lock device may be configured to prevent the door from being opened during operation of the laundry machine. According to the embodiment, the door opening may be limited not only during operation of the laundry machine but also after completion of the operation of the laundry machine when the internal temperature of the laundry machine is higher than or equal to a set temperature.

The controller 9 may also control various displays 922 included in the control panel 92. In addition, the controller 9 may receive a signal from the operation part 921 provided in the control panel 92, and control driving of the entire laundry machine based on the received signal.

The controller 9 may include a main processor configured to control general driving of the laundry machine and a coprocessor configured to control driving of the induction heater. The main processor and the coprocessor may be provided separately and communicatively connected to each other.

According to one embodiment of the disclosure, the output power of the induction heater may be varied. The time required for heating time may be reduced to a maximum degree by increasing the output power of the induction heater to the maximum output power within the allowable condition or range. To this end, this embodiment may include an instantaneous power output unit 99.

The maximum allowable power of the laundry machine may be preset. That is, the laundry machine may be manufactured such that the maximum instantaneous power of the laundry machine is lower than a preset power value during driving. This is indicated as a system allowable power in FIG. 3.

The hardware elements that use the greatest power in the laundry machine according to the embodiment may be the induction heater 8 and the motor for driving the drum, that is, the drive 6.

Figure 3:
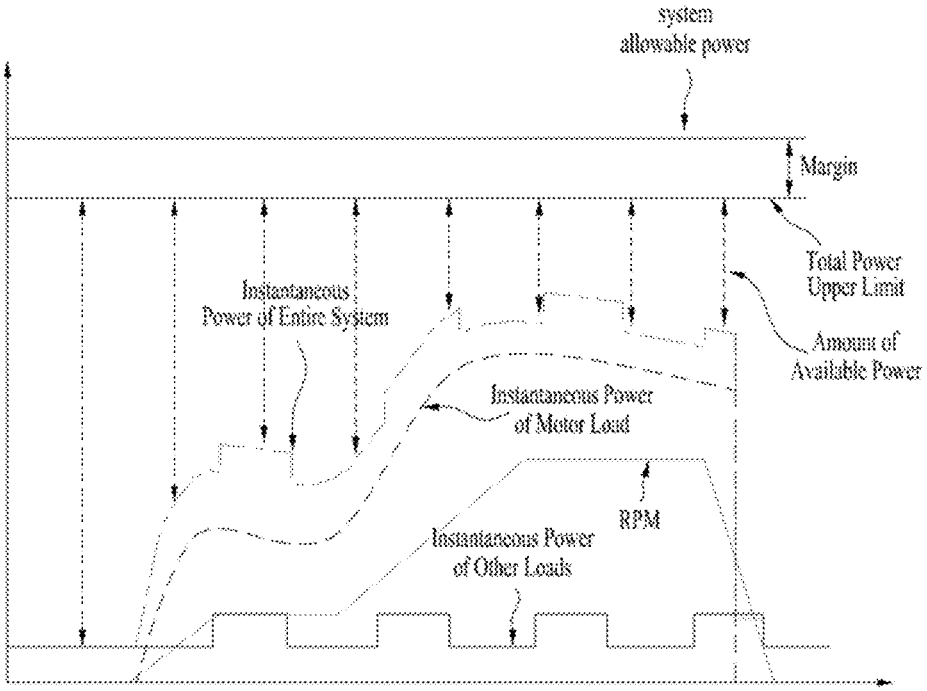
FIG. 3 is a graph illustrating the principle of variation of the output power of an induction heater by varying instantaneous power in a laundry machine according to an embodiment of the present disclosure.

As shown in FIG. 3, the power used in the drive, that is, the instantaneous power tends to increase as the RPM increases. In addition, the instantaneous power used in the drive tends to increase as the laundry eccentricity increases. When the power used in the drive increases, the instantaneous power of the entire system may also tend to increase. That is, most of the instantaneous power of the entire system may be used in the drive.

In heating and spin-drying, power is consumed not only by the induction heater 8 and the drive 6 but also by the control panel 92, the various valves 97, the drain pump 521, and the various sensors 95 and 96. Therefore, as shown in FIG. 3, when the allowable power is determined for the laundry machine system, an upper limit of the total power available to the laundry machine may be preset in consideration of the margin.

In the conventional laundry machine, the output power of the sheath heater in heating and spin-drying is preset. That is, the output power of the sheath heater is preset to be less than the value obtained by subtracting the maximum power except for the sheath heater in heating and spin-drying from the total power upper limit.

In simple terms, when the allowable power value of the laundry machine system is 100 and the margin is 10, the total power upper limit may be 90. When the maximum power value except for the sheath heater in heating and spin-drying is 70, the output power of the sheath heater may be less than 20. Here, the maximum power value except for the sheath heater may be a value obtained by adding all the power values of the hardware elements except for the sheath heater in the maximum RPM and maximum laundry eccentricity environment (extreme environment).

The sheath heater is very limited in variation of output power. In addition, when the sheath heater is used, the heater may not be used as much as possible in a general environment rather than an extreme environment.

In order to address this issue, the present embodiment may include the instantaneous power output unit 99. That is, the embodiment may include an output unit configured to calculate instantaneous power or to calculate and output instantaneous power. The instantaneous power output unit 99 may be provided separately from the controller 9, or a part thereof may be provided separately from the controller, or the instantaneous power output unit 99 may be included in the controller.

As described above, the hardware element that uses the most electric power except for the induction heater 8 during heating and spin-drying may be the motor, that is, the drive 6. In addition, the maximum power value of other hardware except the induction heater and the drive in heating and spin-drying may be preset. The maximum output powers of the other hardware elements may be relatively very low.

Thus, the instantaneous power output unit 99 may be configured to estimate or calculate the instantaneous power of the motor that drives the drum.

For example, the instantaneous power of the motor may be calculated by sensing an input current and a direct current (DC) link voltage input to the motor.

For example, the instantaneous power of the motor may be calculated based on an input current and an input voltage input to the motor.

For example, the instantaneous power of the motor may be calculated based on an input current input to the motor and an alternating current (AC) input voltage applied to the laundry machine.

Accordingly, the instantaneous power output unit 99 may be a unit including a device, an element, or a circuit for sensing current and voltage and configured to output the calculated instantaneous power of the motor.

Once the instantaneous power of the motor is calculated, a possible output power of the induction heater 8 may be calculated. In other words, the possible output power of the induction heater may be a value obtained by subtracting the calculated instantaneous power of the motor and the calculated powers of other hardware elements from the upper limit of the total power.

Here, the instantaneous power of the motor may be changed in a relatively wide range. This is because the RPM variation range and the laundry eccentricity range may be wide. Accordingly, the instantaneous power, that is, current power of the motor may be calculated as the power of the motor. On the other hand, the maximum output power of the other hardware is relatively small and the variation range is narrow, and therefore it may be preset and fixed to a maximum value. Of course, the instantaneous power of the other hardware may be calculated as the maximum output power. However, since the output power of the other hardware is relatively small, a fixed value may be used to exclude addition of a device or circuit for separate power measurement and calculation.

The instantaneous power output unit 99 may be configured to estimate or calculate the total instantaneous power of the laundry machine. For example, the total instantaneous power of the laundry machine may be calculated based on an AC input current and an AC input voltage applied to the laundry machine. The total instantaneous power for heating and spin-drying is the sum of the output powers of the induction heater, motor and other hardware. Thus, the difference between the total instantaneous power and the total power upper limit may mean additional power by which the output power of the induction heater can be increased. For example, when the value of the total instantaneous power is 50 and the total power upper limit is 90, this means that the induction heater may be increased by 40.

Therefore, according to this embodiment, the output power of the induction heater may be ensured as much as possible in the current power state of the system. That is, the output power of the heater may be reduced when the motor consumes much power, and may be increased when the motor consumes a small current.

An embodiment in which the drum is heated through the heating part, the induction heater or the induction coil 9 to heat wash water and an object has been described. By driving the induction heater 9 in the washing process for washing the laundry by heating the wash water or in the drying process for drying the object by heating the object, effective washing and drying may be performed.

Hereinafter, an embodiment of a laundry machine for generating steam with the induction heater 8 described above and supplying the same to an object inside the drum will be described in detail with reference to FIGS. 4 and 5.

Figure 4:
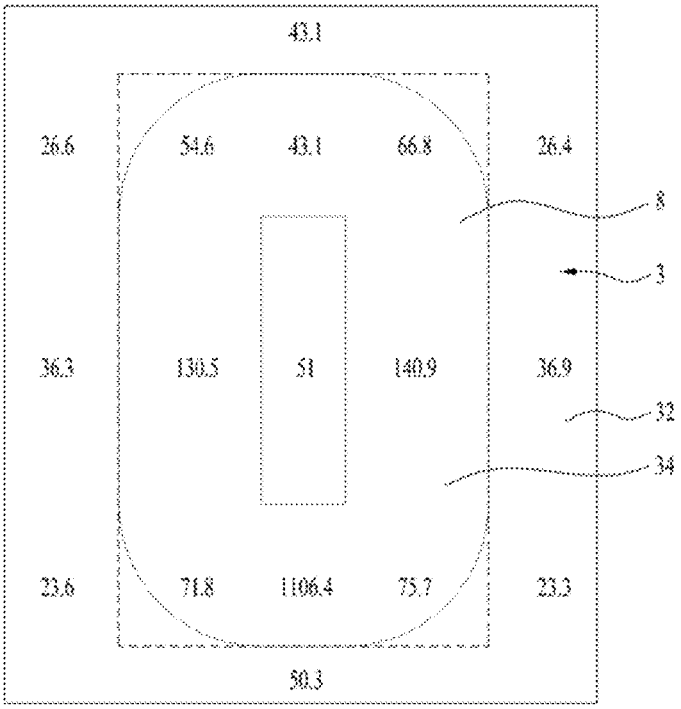
FIG. 4 shows distribution of temperature on and around a heating surface of a drum in a laundry machine according to an embodiment of the present disclosure.
Figure 5:
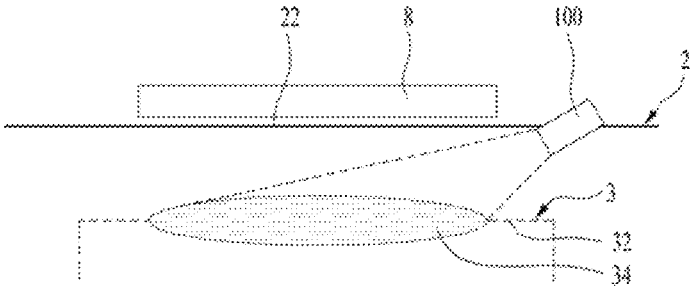
FIG. 5 schematically shows a configuration for steam generation in a laundry machine according to an embodiment of the present disclosure.

FIG. 4 is a plan view schematically showing a part of the outer circumferential surface of the drum, and FIG. 5 schematically illustrates the positional relationship between the tub, the drum, the induction heater and a nozzle.

As shown in FIG. 4, the induction heater or induction coil 8 may be formed in an annular, elliptical or track shape with a hollow portion formed therein. In order to evenly heat the front and rear parts of the outer circumferential surface 32 of the cylindrical drum 3, the induction heater may be formed in an elliptical or track shape.

A heating surface 34 facing the induction heater or induction coil 8 may be formed on the outer circumferential surface 32 of the cylindrical drum 3 so as to correspond to the shape of the induction heater or induction coil 8. That is, the heating surface 34 may be formed in a vertical direction of the induction heater. When current is applied to the induction coil 8, the temperature of the heating surface 34 rises greatly compared to the other parts.

FIG. 4 shows the distribution of temperature on and around the heating surface 34. The figure illustrates an example of temperature distribution obtained immediately after the drum 3 is heated at an electric power of approximately 1200 W for approximately three seconds while the drum 3 is stopped. The lower part of FIG. 4 represents the front of the drum, and the upper part of FIG. 4 represents the rear of the drum.

As can be seen from the figure, the largest temperature rise occurs at the front-back center of the heating surface 34, and the temperature rise is smaller as the position is shifted to both circumferential sides and the front and rear sides of the heating surface 34. If the heating surface 34 deviates 20 mm in the circumferential direction, the temperature increase per second can be significantly reduced to 1/10.

Due to the characteristics of the heating surface 34, the heating surface 34 may be heated to reach a high temperature of about 130° C. to 140° C. for a heating time of about 3 seconds. Accordingly, droplets are sprayed on the heating surface 34, high-quality steam may be generated. In addition, when spray of droplets is concentrated on the heating surface 34, the droplets sprayed out of the heating surface 34 may not be transformed into high-quality steam.

Thus, a spray nozzle 100 for spraying water in a droplet form may be provided, and the positional relationship between the tub 2, the drum 3, the induction heater 8, and the spray nozzle 100 may be determined as shown in FIG. 5. In FIG. 5, the left side represents the front of the tub and the right side represents the rear of the tub. The part shown in the figure is a part of the top of the tub and drum.

When the induction heater 8 is mounted on the upper circumferential surface 22 of the cylindrical tub 2, the spray nozzle 100 may be disposed behind the induction heater 8 and mounted on the upper circumferential surface 22 of the cylindrical tub 2. The heating surface 34 may be formed on a portion of the upper outer circumferential surface 32 of the cylindrical drum 3 to face the induction heater 8. Accordingly, the spray nozzle 100 may be arranged to spray droplets toward the heating surface 34 from a position outside a vertical region of the heating surface 34, that is, a vertical projection region or space of the heating surface 34. In other words, the spray nozzle 100 may be arranged to spray water in a diagonal direction. The spray nozzle 100 may be arranged to spray water downward.

The spray nozzle 100 is configured to supply water in the form of droplets by water pressure. When water is supplied in a reverse direction to the gravity direction, the water may fall without reaching the targeted heating surface 34. Then, water, not steam, may flow into the drum through the through holes 33 in the outer circumferential surface 32 of the drum. For this reason, the spray nozzle 100 may be arranged to supply water downward.

In order to spray water onto the heating surface 34 in the form of droplets, the spray nozzle 100 needs to achieve the following objects.

First, the pressure loss through the nozzle should be minimized. Fluctuations in water pressure may occur. Accordingly, a large pressure loss at a low water pressure may make it difficult to spray water in the form of a desired droplet.

Second, the spray area should be as wide as possible. In other words, the droplets should be sprayed evenly over the entire area of the heating surface, rather than over a part of the area. This is because high-quality steam may be generated through such spray.

Figure 6:
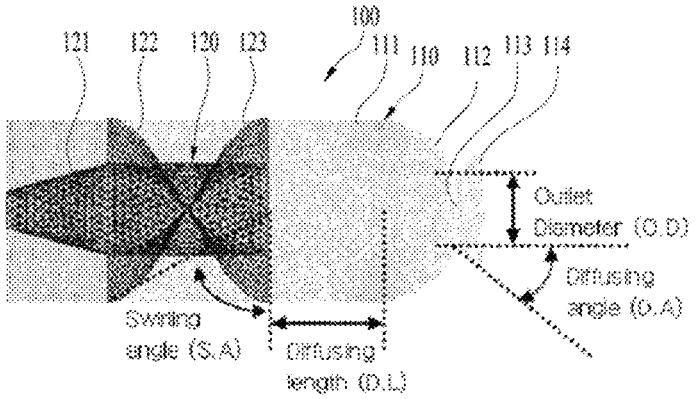
FIG. 6 shows an example of the spray nozzle shown in FIG. 5.

An embodiment of the spray nozzle 100 for achieving such objects is shown in FIG. 6.

The spray nozzle 100 may include a body 110 and a swirler 120 arranged inside the body.

The body 110 may be formed in the shape of a hollow cylindrical pipe. A transition part 112 whose outer diameter is gradually reduced may be formed at a distal end of the body, and an outlet 113 may be formed at the end of the transition part 112. A diffuser 114 expanding in a radial direction may be formed at the radially outer side of the outlet 113. The diffuser may be formed in an expansion tube shape.

The swirler 120 may include a swirler body 121 having a funnel shape positioned opposite to the flow direction of water, and the inside of the swirler body 121 is empty. Thus, water may flow through the swirler body 121. In addition, the front and rear of the exterior of the swirler body 121 may be provided with blades 122 and 123 having shapes that cross each other.

The area of the exterior of the swirler body 121, that is, the area between the rear blade 122 and the front blade 123 may be referred to as a swirling region, and the rotational speed component of water is generated in the swirling area. That is, vorticity is generated in the swirling region.

Vorticity of water having a rotational speed component outside the swirler body 121 may then disappear in the body 110, and thus water droplets may be dispersed over a wide area.

The swirling angle, which is an angle formed by a line connecting the radially outer end of the rear blade 122 and the center of the front blade, the diffusing length, which is a straight line distance from the swirler to the transition part, the inner diameter of the outlet, and the diffusing angle of the diffuser were found to be very important factors in achieving the objects of the spray nozzle 100.

First, the inner diameter of the outlet should be maintained to be at least 3 mm in order to prevent clogging of the outlet by foreign substances. It was found that the clogging can be prevented and the droplets can be sprayed smoothly when the inner diameter is from 3.5 mm to 4.5 mm.

Figure 7:
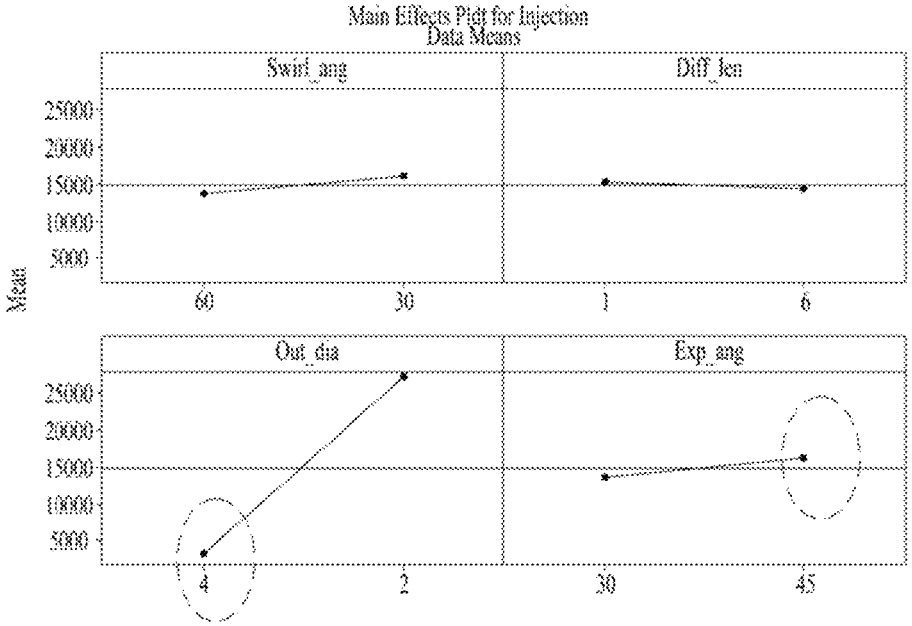
FIG. 7 illustrates a relationship between a swirl angle, a diffusion region length, an outlet diameter, a diffusion angle, and flow passage resistance of the spray nozzle shown in FIG. 6.

As shown in FIG. 7, the swirling angle, the diffusing length, and the diffusing angle may have a very small influence on the pressure loss, and the pressure loss may be greatly affected by the inner diameter of the outlet. A threshold of pressure loss is obtained when the inner diameter is approximately 3 mm. Accordingly, the outlet may be formed to have an inner diameter of approximately 3.5 mm to 4.5 mm, preferably 4 mm.

Figure 8:
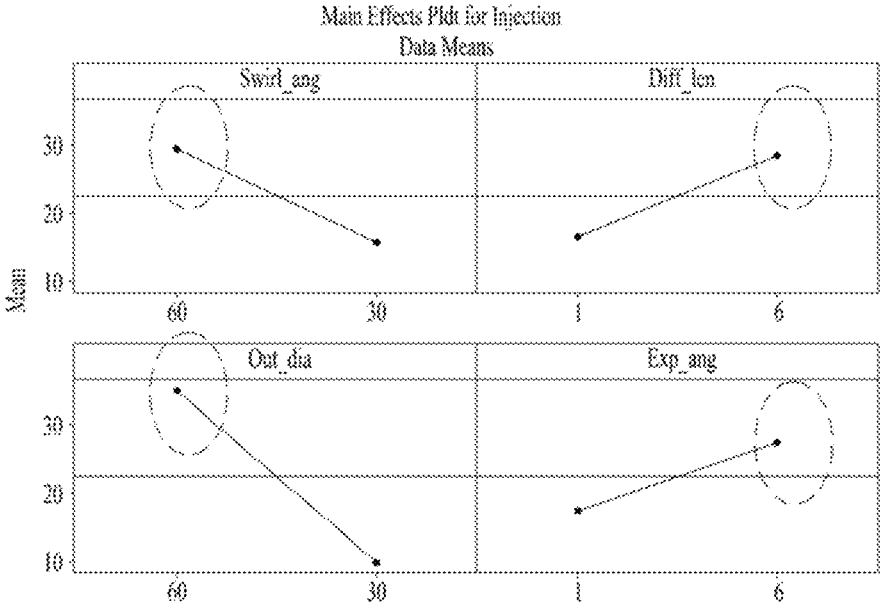
FIG. 8 illustrates a relationship between the swirling angle; the diffusion region length; the outlet diameter; the diffusion angle, and the spray performance of the spray nozzle shown in FIG. 6.

As shown in FIG. 8, it was found that the swirling angle, the diffusing length, the diffusing angle, and the inner diameter of the outlet all have a significant influence in relation to the spraying performance.

As may be seen from the figure, based on the threshold of the spray performance, the spray performance may be lowered as the swirling angle decreases from 60 degrees to 30 degrees. Accordingly, the swirling angle may be formed to be approximately 50 to 70 degrees, preferably 60 degrees.

As may be seen from the figure, spray performance may be improved as the diffusing length decreases from 1 mm to 6 mm. Accordingly, the diffusing length may be formed to be approximately 4 mm to 8 mm, preferably 6 mm.

As may be seen from the figure, spray performance may be lowered as inner diameter of the outlet decreases from 4 mm to 2 mm. Accordingly, the inner diameter of the outlet may be formed to be 3.5 mm to 4.5 mm, preferably 4 mm.

As may be seen from the figure, spray performance may be improved as the diffusing angle decreases from 30 degrees to 45 degrees. Accordingly, the diffusing angle may be formed to be 40 degrees to 50 degrees, preferably 45 degrees.

An embodiment of a laundry machine that generates steam by forming a heating surface on the outer circumferential surface of the drum and spraying water on the heating surface in the form of droplets through the spray nozzle has been described above.

Hereinafter, an embodiment in which the heating surface is formed on a portion other than the outer circumferential surface of the drum will be described in detail.

Figure 9:
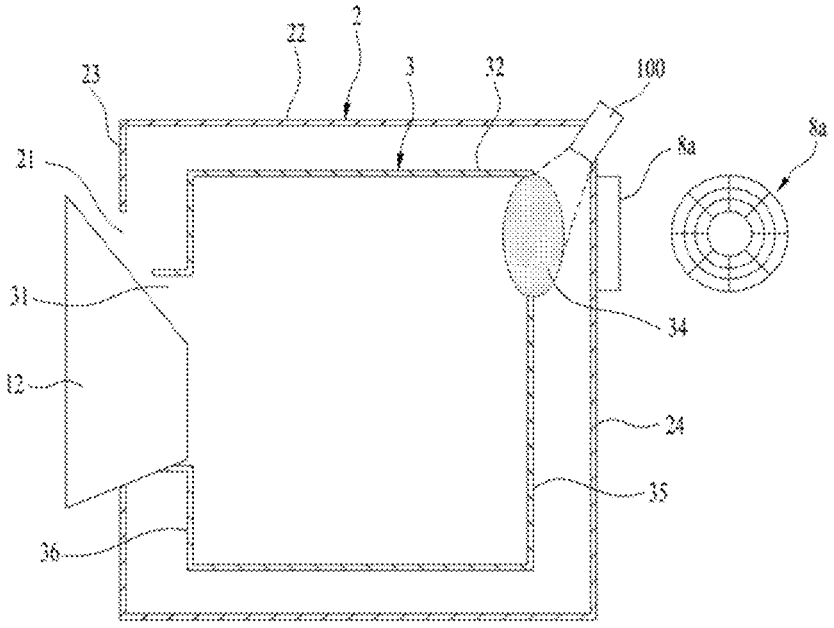
FIG. 9 is a plan view schematically showing elements for generating steam and a steam induction heater (coil) of a laundry machine according to another embodiment of the present disclosure.

As shown in FIG. 9, an induction heater 8*a* may be arranged on an upper portion of a rear wall surface 24 of the tub. That is, it may be mounted on the rear wall surface of the tub on the outside of the tub. Therefore, the heating surface 34 may be formed on the upper portion of the rear wall surface 35 of the drum 3 to face the induction heater 8*a*.

The heating surface 34 may be constantly fixed at a specific position when the drum 3 is stopped. However, as the drum 3 rotates, the heating surface 34 is continuously changed. Therefore, this embodiment may be the same as the previous embodiment except for the position of the drum heating surface 34, the position of the spray nozzle and the spray direction, which are changed from the previous embodiment due to the changed mounting position of the induction heater 8*a*.

In this embodiment, the induction heater 8*a* is not intended to heat wash water or an object. Basically, it may be provided only for steam generation. This is a different point from the previous embodiment. In addition, since wash water or an object need not be heated, the induction heater 8*a* in this embodiment may be formed in a circular shape. In this embodiment, the spray nozzle 100 may be used in the same manner as the previous embodiment. Only the installation position and spraying direction of the spray nozzle may be different from those of the previous embodiment.

Although not shown in FIG. 9, the induction heater 8 shown in FIG. 5 may be provided separately from the induction heater 8*a* for steam generation. That is, two induction heaters may be provided such that one induction heater may serve to heat the drum to heat wash water and an object, and the other induction heater may serve to heat the drum for steam generation.

Another embodiment according to the present disclosure will be described with reference to FIG. 10.

This embodiment may be different from the above-described embodiments in terms of the position of the induction heater 8*a*. Specifically, the induction heater 8*a* may be arranged at the front of an upper portion of a front wall 23 of the tub 2. A heating surface 34 may be formed on the upper portion of the front wall 36 of the drum 3 so as to correspond to the induction heater 8*a*. The spray nozzle 100 may be arranged above the induction heater 8*a*. That is, it may be mounted on the front wall 23 of the tub above the induction heater 8*a*. The steam valve 97*c* may be located behind the laundry machine, and accordingly water may be supplied by being guided from the steam valve 97*c* to the spray nozzle 100 through a connection hose 13. The spray nozzle 100 sprays water in the form of droplets downward in an oblique direction. That is, water is sprayed toward the heating surface 34.

Figure 10:
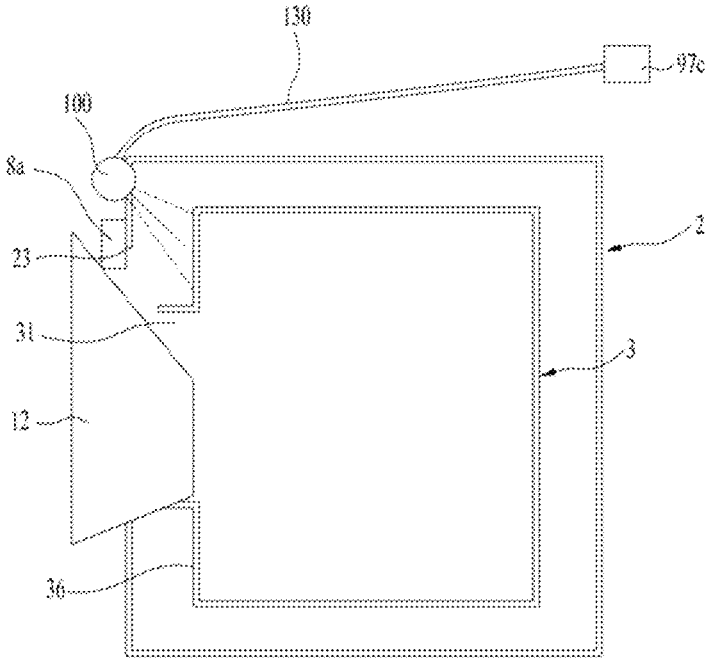
FIG. 10 schematically shows elements for steam generation of a laundry machine according to another embodiment of the present disclosure.

Although not shown in FIG. 10, the induction heater 8 shown in FIG. 5 may be provided separately from the induction heater 8*a* for steam generation. That is, two induction heaters may be provided such that one induction heater may serve to heat the drum to heat wash water and an object, and the other induction heater may serves to heat the drum for steam generation.

Another embodiment according to the present disclosure will be described with reference to FIG. 11.

This embodiment may be the same as the embodiment shown in FIG. 9. However, water may be supplied to the spray nozzle through the steam pump 97*c*, 511 rather than through an external water supply source.

As described above, the laundry machine according to an embodiment of the present disclosure may be configured to resupply water stored in the lower portion of the tub from the inner upper portion of the tub to the lower portion. That is, water may be pumped and resupplied through a circulation pump 511. The water pumped using the circulation pump 511 may be sprayed toward the heating surface 34 positioned on an upper portion of the rear wall 35 of the drum. A connection hose 130 may be arranged between the circulation pump 511 and the spray nozzle 100 to supply water in the lower portion of the tub to the spray nozzle.

Although not shown in the figure, the connection hose 130 may be provided with a flow passage switching valve. That is, the connection hose may be branched into a passage through which water is sprayed onto the heating surface and a passage through which water is directly supplied into the drum, and the discharged water may be diverted through the flow passage switching valve.

Unlike the circulation pump 511, the steam pump 97*c* may be configured to pump water stored in a separate space, not the water stored in the tub.

Figure 11:
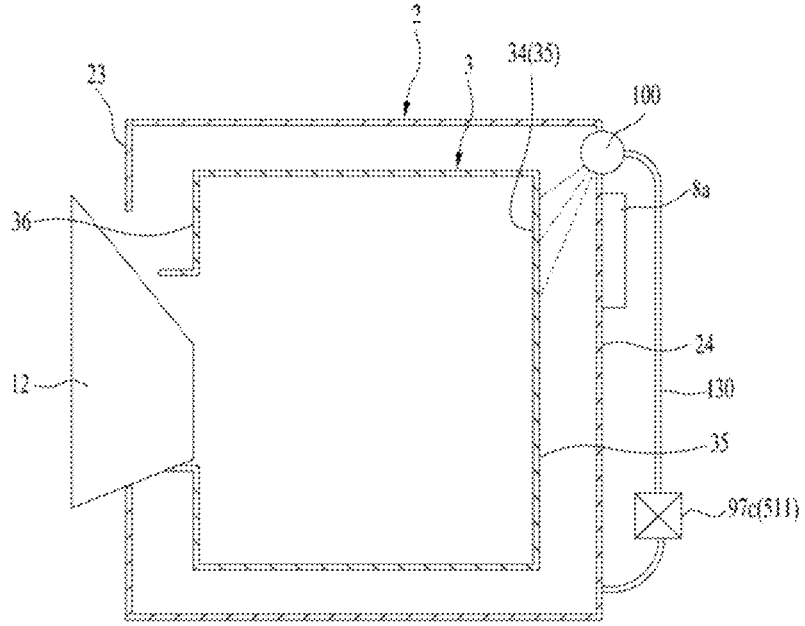
FIG. 11 schematically shows elements for steam generation of a laundry machine according to another embodiment of the present disclosure.

Although not shown in FIG. 11, the induction heater 8 shown in FIG. 5 may be provided separately from the induction heater 8*a* for steam generation. That is, two induction heaters may be provided such that one induction heater may serve to heat the drum to heat wash water and an object, and the other induction heater may serve to heat the drum for steam generation.

Figure 12:
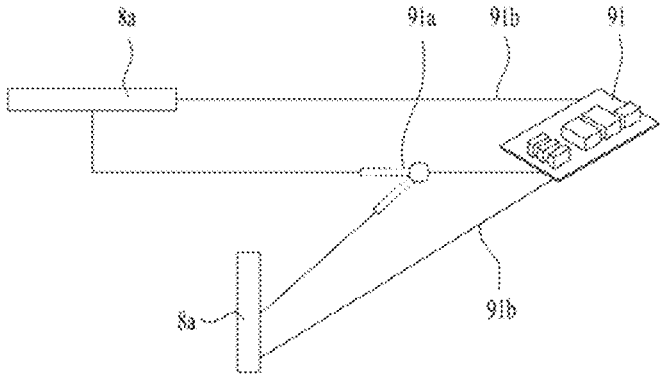
FIG. 12 schematically illustrates a connection relationship between one inverter drive and two induction heaters in a laundry machine according to an embodiment of the present disclosure.

FIG. 12 schematically illustrates the concept of controlling the output power of induction heaters through one inverter drive 91 when two induction heaters 8 and 8*a* are provided.

One induction heater 8 may be configured to heat the outer circumferential surface of the drum to heat wash water or an object. The induction heater 8 may be driven in the washing process or the drying process. The other induction heater 8*a* may be configured to heat the front wall or the rear wall of the drum so as to generate steam. The induction heater 8*a* may be driven for steam generation in the washing process, drying process or refreshing process.

When two induction heaters 8 are provided, they may be used for different purposes. In terms of power consumption, it is necessary to exclude driving of both induction heaters at the same time. Since the induction heaters are used for different purposes, necessity of driving of both induction heaters at the same time may be low. Accordingly, the output powers of both induction heaters may be controlled through one inverter drive 91. Thereby, the manufacturing cost may be reduced compared to a case where inverter drives are individually provided to the induction heaters.

Specifically, a single inverter drive 91 may be connected to the induction heater 8 (which may be referred to as a main induction heater) through a first connection 91*b* and connected to the induction heater 8*a* (which may be referred to as a steam induction heater) through a second connection 91*c*. Here, a switch 91*a* may be provided. The switch may be configured to selectively connect one of the main induction heater and the steam induction heater to the inverter drive 91.

Since the proportion of driving, frequency, or time of the main induction heater increases over that of the steam induction heater, the switch may connect the main induction heater and the inverter drive. In addition, the position of the switch may be changed to connect the steam induction heater and the inverter drive to generate steam. Such operation of the switch may be performed through the processor 9. This is because the processor 9 may control overall operation of the entire laundry machine and determine whether the main induction heater or the steam induction heater should be driven at a certain time.

Various embodiments have been described focusing on the elements for generating steam through the induction heater. Description has been given above, focusing on the elements for the embodiment of steam generation through the main induction heater for heating wash water or the drum, the embodiment of steam generation through the steam induction heater for steam generation only, and the embodiment with two induction heaters.

Figure 13:
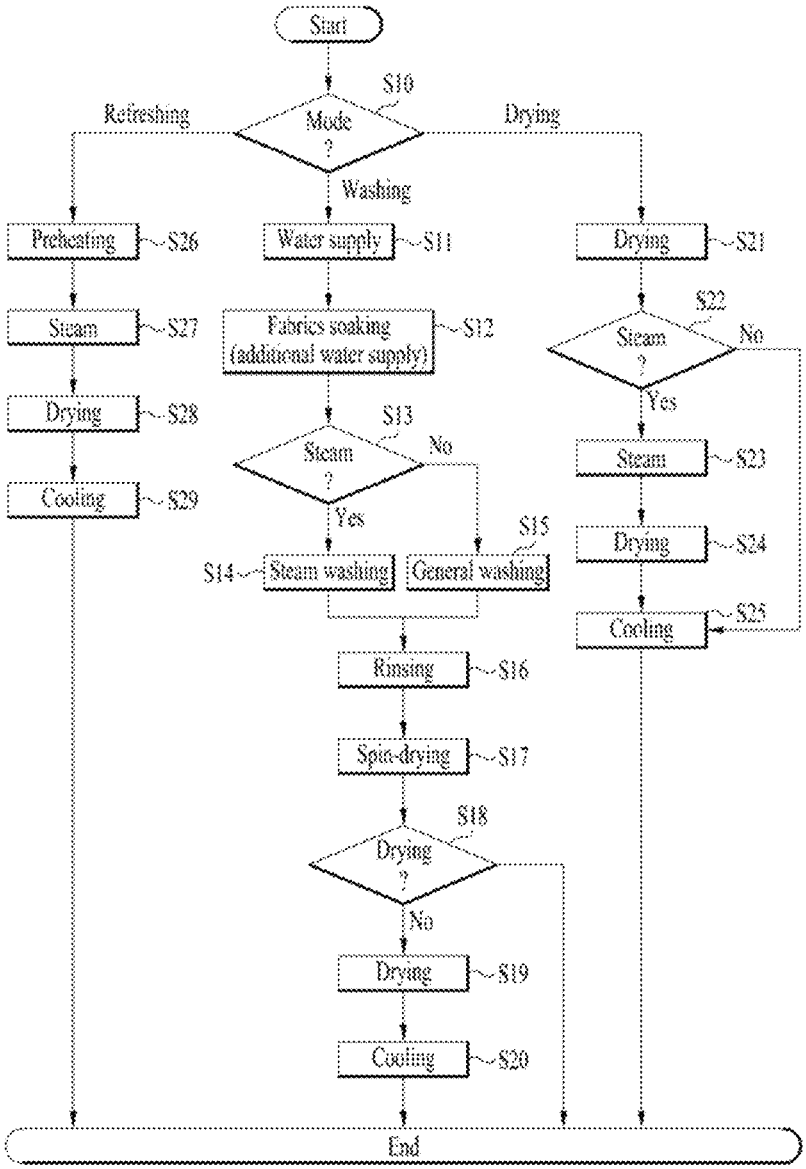
FIG. 13 illustrates an example of control logic according to an embodiment of the present disclosure.

Hereinafter, a method of controlling a laundry machine according to an embodiment of the present disclosure will be described in detail with reference to FIG. 13.

In a laundry machine, steam may be used in the washing process of washing objects through wash water and a detergent. Steam may be used in the drying process of drying wet objects by heating the objects. In particular, the water content may be controlled by supplying steam at the end of the drying process. Thereby, an antistatic effect may be expected. Steam may be used in the refreshing process to supply steam to dry objects to remove odors and reduce wrinkles.

Here, the washing process, the drying process and the refreshing process may form one course in the laundry machine and may be sub-courses included in one course. In the laundry machine, a course means that a plurality of processes is executed sequentially and automatically and then terminated. In one example, a washing course means that the washing process, the rinsing process and the spin-drying process are performed sequentially and automatically. The washing course may additionally include a drying process or a refreshing process.

A drying course may include only a drying process of heating the object, and may include a cooling process of cooling the object after the drying process.

A refreshing course may include only a refreshing process of supplying steam to the object, and may include a drying process of drying the object after the refreshing process and/or a cooling process.

The laundry machine according to this embodiment may include a washing course using steam, a drying course using steam, and a refreshing course using steam in one course, and may perform the courses. In addition, the laundry machine according to this embodiment may use steam in the washing process, drying process and refreshing process performed in one course.

Steam may be used for different purposes in washing, drying and refreshing. In addition, the state of the object at the time of supplying steam may also differ among the processes. For this reason, driving of the induction heater and driving of the drum may be differently controlled at the time for steam generation and the time for steam supply.

Hereinafter, a control method using steam for each of the washing course, the drying course and the refreshing course will be described. As described above, drying and refreshing may be included in the washing course. One laundry machine may be configured to perform all of these courses or to perform only one of the courses.

When a user selects a specific course through a user interface, the processor senses the selected course (S10) and controls the laundry machine to perform the selected course.

When the washing course is selected, washing is started by performing water supply S11. Dispersion of fabrics, sensing of fabrics, or sensing of the amount of fabrics may be performed by driving the drum before water supply. Dispersion of fabrics, sensing of fabrics, or sensing of the amount of fabrics may be performed by driving the drum during and after water supply.

After the water supply (S11), fabrics soaking may be performed by driving the circulation pump 511 while the drum is driven. During the fabrics soaking operation, the object is sufficiently wet and the detergent is dissolved.

After completion of the fabrics soaking, steam washing (S14) or general washing (S15) of washing without steam may be performed. After the fabrics soaking, the steam washing or general washing may be performed without additional supply of water into the tub. In the steam washing and general washing, wash water may be heated by driving the induction heater 8 as necessary. This operation is irrelevant to steam.

After completion of the fabrics soaking, the water level in the tub is lower than the lowest end of the drum. Accordingly, even if the drum rotates, wash water is not supplied into the drum. However, the circulation pump 511 is driven to supply wash water and detergent water to the object in the drum to perform washing. Here, since a small amount of wash water is used, energy for heating the wash water may be saved, and the amount of water may be reduced. In addition, since washing is performed with high concentration detergent water, washing efficiency may be enhanced.

Whether to perform the steam washing (S14) and general washing (S15) may be determined after the fabrics soaking (S13), or may be determined (checked) in a course check step (S10), which is an initial stage of washing.

In the steam washing or general washing, heating of wash water may be performed while the tumbling motion or the filtration motion of the tub is performed or the tumbling motion and the filtration motion are performed in succession. At this time, driving of the circulation pump may be performed in synchronization with driving of the drum. In addition, the driving of the drum may be operatively connected with driving of the induction heater 8. In other words, the induction heater 8 may be operated only when the drum rotates. However, at the beginning and end of rotation of the drum, the driving of the induction heater 8 may be limited to prevent overheating of the object. For example, the induction heater 8 may be driven when the drum is accelerated to 20 RPM or a higher speed, and driving of the induction heater 8 may be stopped when the drum is decelerated to 20 RPM or a lower speed.

Here, the tumbling motion may refer to a motion of rise and fall of the object repeated inside the drum when the drum rotates at about 40 to 60 RPM. The filtration motion may refer to a motion of integral rotation of the drum and the object that occurs when the drum rotates at about 70 to 120 RPM, preferably 80 to 100 RPM.

Since the filtration motion is a motion that occurs when an object is in close contact with the inner circumferential surface of the drum, wash water is discharged from the object by centrifugal force in the motion. Therefore, the filtration motion may address an issue of a small amount of wash water, which obstructs the circulation pump from operating properly.

In the washing process, control of driving of the induction heater and rotation of the drum in the steam step may be different from that in the wash water heating step. In addition, water should be sprayed through the spray nozzle to generate steam. The steam step in the washing process will be described later in detail.

When the steam washing (S14) or general washing (S15) is finished, the washing is finished through the rinsing process S16 and the spin-drying process S17. After the washing, it is determined whether the drying process is selected (S18). When the drying process is not selected, the course is terminated. When the drying process is selected, the drying process S19 is performed to dry the object for which the washing has been completed. After the drying process S19, if necessary, the cooling process S20 is performed and then the course is terminated.

Control of driving of the induction heater and rotation of the drum in the steam step in the drying process may be different from that in the wash water heating step and the steam step in the washing process. The steam step in the drying process will be described later in detail.

When the drying course or drying process is selected in the course check step S10, the drying course or drying process S21 is performed. It is determined whether the steam step is included in the drying process S22. When the steam step is not included in the drying process, the cooling process S25 may be performed after the drying process, when necessary, and the course may be terminated.

When the steam step is included in the drying process, the steam step S23 is performed after the drying process 521. The steam step S23 may be carried out at the end of the drying process to supply steam to the object to reduce static electricity and wrinkles. The operation may be the same as the general drying process without the steam step until the water content reaches approximately 10% or more. When the water content reaches approximately 10%, to 5%, steam may be supplied to remove static electricity and dry wrinkles without wetting the object.

Thereafter, additional drying S24 may be performed, and if necessary, a cooling process S25 may be performed. Then, the course may be terminated.

The drying process may be a process of heating an object by heating the drum through an induction heater. The water inside the tub and the water absorbed by the object have been discharged as much as possible in the spin-drying process. Accordingly, rotation of the drum in the drying process is controlled differently from rotation of the drum in heating wash water in the washing process. Of course, the induction heater may be driven only when the drum is driven, and the threshold RPM for driving of the induction heater may be the same as when washing is performed.

The drum motion in the drying process may vary depending on the type or amount of the object. That is, it may vary depending on the conditions of the drying load. This is because effective drying is carried out only when a contact occurs between the drum and the load, which are heated by the induction heater.

Large general loads are entangled with each other, making it difficult to disperse or rearrange fabrics through the tumbling motion. In addition, the positions of the fabrics are not changed in the tumbling motion in many cases. Even when they are turned side by side, the fabrics may repeat rise and fall without the positions thereof changed. In this case, the upper portion of the fabrics falls without coming into contact with the upper portion of the inner circumferential surface of the drum. In addition, the lower portion of the fabrics may contact the lower portion of the inner circumferential surface of the drum having a lowered temperature, or other fabrics may restrict the contact. Accordingly, in the side-by-side turn tumbling motion of the drum, only both side portions of the fabrics may be heated and dried together with the inner circumferential surface of the drum, and the upper and lower portions thereof are likely to be insufficiently dried.

Therefore, the filtration or space-securing motion of bringing the load into close contact with the inner circumferential surface of side-by-side turn at 90 to 110 RPM may be carried out for large loads, such as large general loads. Of course, rotation of the drum and driving of the induction heater may be operatively connected with each other.

When the load is brought into close contact with the inner circumferential surface of the drum by centrifugal force, a space may be secured in the center portion of the drum. When the drum stops after the space-securing motion, the load will drop into the empty space due to gravity. This may lead to rearrangement, distribution, and position change of the load. The tumbling motion may be performed after the space-securing motion ends. The space-securing motion and the tumbling motion may be carried out for about 20 to 30 seconds. Drying may be performed while one drum motion cycle is carried out through one space-securing motion and two tumbling motions. A drum stop period of about 2 to 4 seconds may be provided between the space-securing motion and the tumbling motion and between the tumbling motions. Since the load is expected to drop between the space-securing motion and the tumbling motion, the drum stop period between the space-securing motion and the tumbling motion may be longer than the drum stop period between the tumbling motions.

When a large load such as duvet or a padding jumper is in the drum, it may fully occupy the inside of the drum and thus tend to rotate integrally with the drum even during the tumbling motion. In this case, only a part of the duvet load (part in contact with the inner circumferential surface of the drum) may be heated, and the part thereof arranged close to the center of the drum may not be heated. Thus, there is a high possibility that the load has an over-dried part and an insufficiently dried part.

In addition, a large load may fully occupy the inside of the drum upon being introduced into the drum, and it is not easy to resolve the maldistribution of the load formed at this time. Thus, when the drum is accelerated in the above-described space-securing motion, the maldistribution is very likely to cause vibration, and it may not be easy to enter the space-securing motion smoothly.

Therefore, in this case, a turn-over acceleration motion may be carried out at a speed lower than the RPM of the space-securing motion to bring the load into close contact with the inner circumferential surface of the drum to some extent, and then a space may be further secured in the center of the drum through the space-securing motion. Then, the load may be rearranged, distributed, and changed in position through the tumbling motion.

The turn-over acceleration motion has RPM between the RPM of the tumbling motion and the RPM of the space-securing motion. The turn-over acceleration motion may be performed at approximately 70 to 80 RPM. The turn-over acceleration motion does not maintain the speed by accelerating to 70 to 80 RPM from the beginning. In the turn-over acceleration motion, the speed may be initially increased to the tumbling RPM and the tumbling RPM is maintained. Then, the speed may be further increased and the increased speed may be maintained. Approximately 60 RPM may be a primary target RPM, and approximately 80 RPM reached after a predetermined time may be a secondary target RPM. The drum may be rotated at the secondary target RPM for a predetermined time.

In the turn-over acceleration motion, the object is rotated integrally with the drum. Therefore, heating is effective because the contact between the object and the drum is maintained at a moderate RPM. In addition, through the space-securing motion, even the inside of a thick object may be easily heated. Thereafter, the object may be evenly heated by rearranging the load and changing the position through the tumbling motion.

After the turn-over acceleration motion repeats the forward and reverse rotations a plurality of times, the space-securing motion and the tumbling motion may be performed. The turn-over acceleration motion, the space-securing motion, and the tumbling motion may be sequentially performed repeatedly to complete one drum motion cycle.

Accordingly, a large load such as a duvet load or a padding jumper load may be dried through the drum motion cycle.

Most of the damages to the object, such as shrinkage or deformation of the object during drying, may be caused by friction or mechanical force between the objects, which may be the cause of about 80% of the damages to the objects. A general load may not undergo such severe damages, but delicate clothing may undergo many problems due to the damages to the object.

In the case of delicate clothing, when the drum is rotated at a high RPM, tensile force may be applied to the clothing by the centrifugal force, and mechanical force may be applied to the clothing. In the tumbling motion, there is a high possibility that tensile force is generated due to friction between the clothes or entanglement of the clothes. Therefore, for delicate clothing, the turn-over acceleration motion may be primarily performed, and the tumbling motion may be secondarily performed to assist in dispersing the fabrics, rearranging the fabrics, and changing the position of the fabrics.

The turn-over acceleration motion may be driven through repetition of forward and reverse rotations multiple times, and then the tumbling motion may be performed through repetition of forward and reverse rotations a smaller number of times. For example, the turn-over acceleration motion may be performed through five repetitions of forward and reverse rotations, and then the tumbling motion may be performed through two repetitions of forward and reverse rotations. The turn-over acceleration motion and the tumbling motion may constitute one drum motion cycle. Accordingly, the drying operation may be performed in a drum motion cycle consisting of the turn-over acceleration motion and the tumbling motion for a load such as delicate clothing.

Conditions for load drying may be determined at various points of time, such as sensing of the amount of fabrics in the washing process, sensing of the amount of wet fabrics after water supply, a course selected by the user, and sensing of the amount of fabrics in the drying process. Of course, the conditions for load drying may be determined by combining the factors derived or input at various points of time.

In the above embodiment, the time or which the drum is continuously rotated may be shorter than 1 minute, and the drum may be rotated in one direction for about 20 to 30 seconds. Then, the rotation direction may be changed after the drum motion is stopped.

When the drum stops rotating, driving of the induction heater is also stopped. Accordingly, a specific load may be prevented from being overheated by continuous driving of the induction heater during rotation of the drum for a long time.

When the refreshing course or refreshing process is selected in the course check step S10, the refreshing course or refreshing process is performed (S26). The refreshing process may perform the steam step by default. In order to maximize the high-temperature steam effect, a preheating step S26 of heating the drum before steam generation may be performed. Of course, the preheating step may be omitted as necessary.

The steam step S27 may be the same as the steam step in the drying process. When the steam step is finished, the course may be terminated through the drying (S28) and the cooling (S29).

The refreshing course may be performed on a small amount of dry clothing. In particular, the course may be provided on the basis of 2-3 pieces of clothing, such as a shirt. Therefore, the drum motion in the preheating step S26 may be a tumbling motion. The steam step in the refreshing course may be the same as the steam step in the drying course (dry process). Details thereof will be described later.

Figure 14:
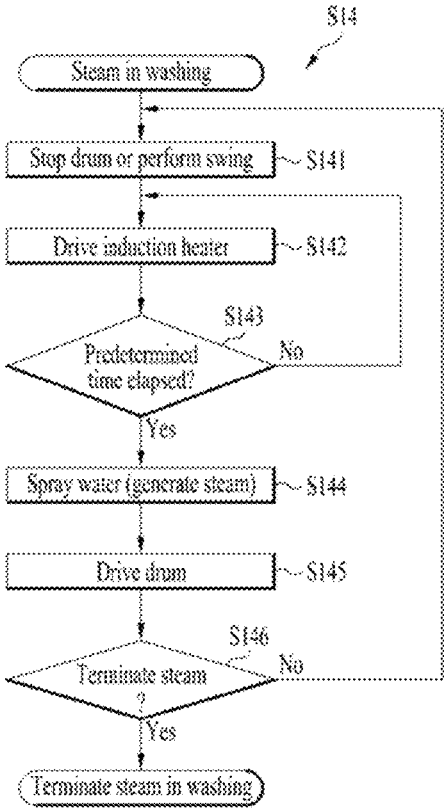
FIG. 14 shows an example of control logic for steam generation and supply in a washing process (washing course) in FIG. 13.

Hereinafter, the steam step in the washing process will be described in detail with reference to FIG. 14.

In the washing process, the temperature of the drum may be lower than in the drying process due to wet objects and wash water. Accordingly, the processor may perform a control operation to generate steam by spraying water through the spray nozzle after preheating the drum.

The drum may be preheated by driving the induction heaters 8 and 8*a*, and then water may be sprayed toward the heating surface of the drum to generate steam (S144). After it is determined that about 2-3 seconds has elapsed after start of the induction heater (S143), water may be sprayed.

As described above, the degree of temperature rise through heating of the drum in the washing process is smaller than the degree of temperature rise through heating of the drum in the drying process. When the drum is heated during rotation of the drum, the heating surface of the drum is shifted in the circumferential direction. Accordingly, it may be difficult to generate high-quality steam due to insufficient heating of the heating surface.

For this reason, the induction heater may be operated in the steam step of the washing process while the drum is stopped or makes a swing motion. The heating surface is fixed when the drum is stopped. Thus, the heating surface may be heated rapidly. The swing motion of the drum refers to repetition of the forward and reverse rotation of the drum within 180 degrees. Since the RPM is low and the variation range of the heating surface is narrow, the heating surface may be relatively expanded. Surface heating of the heating surface heats an external air layer adjacent to the heating surface.

The spray nozzle 100 sprays water onto the heating surface of the drum provided on the outer circumferential surface of the drum, the outer surface of the front wall of the drum, or the outer surface of the rear wall of the drum. Thus, when water reaches the heating surface, it turns into steam and the steam is located in the space between the tub and the drum.

This steam should be supplied into the drum to supply moisture and heat to the object. Therefore, after the steam is generated, the processor 9 needs to drive the drum (S145) such that the steam flows into the drum through the through holes 33 or the drum front opening 31. Thus, the driving motion of the drum before steam generation may differ from the driving motion of the drum after steam generation.

This steam step may be performed a plurality of times. The number of times the steam step is performed may be determined based on the time factor or the temperature factor.

Steam in the washing process is primarily intended to heat the object and air inside the tub and the drum. That is, high-temperature steam is supplied to ambient air to raise the temperature of ambient air rapidly.

Accordingly, the steam step may be repeated through the drying temperature sensor 96 until the temperature inside the tub is increased to a target temperature. When the steam step is additionally performed after heating the wash water, the steam step may increase the temperature of the wash water. Accordingly, the steam step may be repeated until the temperature of the wash water is increased to the target temperature through the wash water temperature sensor 95.

A time factor may be used together with or independently of the temperature factor. The steam step may be repeated for a predetermined time.

Generating steam a plurality of times means performing water spray a plurality of times. Accordingly, the preheating may be performed every time the water spray is performed. In addition, driving of the induction heater may be continued between the sprays.

Stopping the drum or making the swing motion to perform the steam step may lead increase in the washing time. This is because, when the time for applying mechanical force through driving of the drum is set, increasing the drum stop time in the middle means increasing the entire washing time.

Therefore, a separate drum stop is not performed to perform the steam step. Instead, driving of the induction heater and water spray may be performed when the drum is stopped to reverse the rotation direction of the drum. That is, the induction heater may be driven and water may be sprayed while the drum stops for about 3 to 5 seconds to reverse rotation after forward rotation. When steam is generated after water spray, the drum may be rotated again, and thus the generated steam may be smoothly supplied into the drum.

When the drum starts to rotate after stopping, the swing motion may be performed temporarily. In order to rotate in one direction, the drum may be rotated by a predetermined angle in the opposite direction and then continue to be rotated in one direction. Therefore, the induction heater may be driven immediately before the drum stops after rotating in one direction, and the drum may be rotated in the opposite direction after performing a swing motion in the one direction. Thus, the induction heater may start to be driven immediately before the drum stops, and water may be sprayed immediately before the drum starts the swing motion after stopping.

Therefore, by performing preheating of the induction heater using the stop time or swing time between the drum motions, high-quality steam may be generated and supplied, and the washing time may be prevented from increasing.

The steam quality (high temperature and low density) in the washing process may have a relatively small influence on the washing effect. That is, the steam quality required in the washing process may be lower than the steam quality required in the drying process and the refreshing process.

Accordingly, water may be sprayed while the driving of the drum is performed together with the driving of the induction heater. Since the drum is not in the stationary state, the temperature of the heating surface of the drum may be relatively low. Accordingly, the steam quality is lowered. In this case, however, steam may be generated at any time while the drum is rotating during the washing process. That is, basically, the washing process algorithm only needs to determine a suitable time for spraying water. Accordingly, the control algorithm may be very simple.

In addition, as described above, in the laundry machine configured to heat wash water through an induction heater, the circulation pump is driven in the washing process. Accordingly, a part of the number of times the circulation pump is driven may be replaced by the operation of the spray nozzle. Then, wash water heating and ambient air heating by steam may be repeatedly performed alternately.

Figure 15:
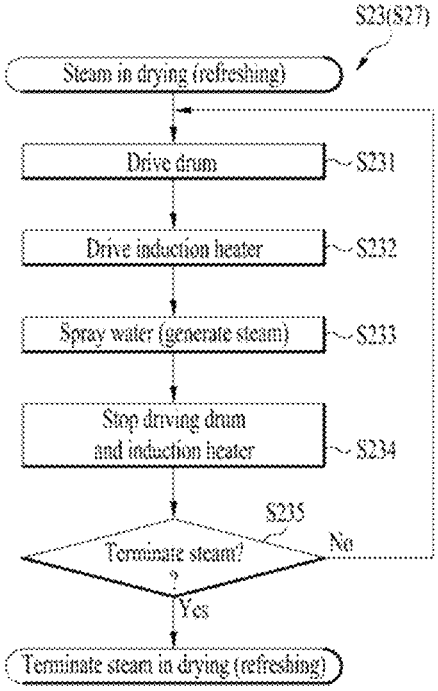
FIG. 15 shows an example of control logic for steam generation and supply in a drying process or a refreshing process (drying course or refreshing course) in FIG. 13.

Hereinafter, the steam steps S23 and S27 in the drying course (process) or the refreshing course (process) will be described in detail with reference to FIG. 15.

As described above, when the induction heater is driven in the drying course or the refreshing course, the temperature rise of the drum may be larger. In the drying course, the steam step is performed at the end of the drying process, and thus most of the steam is supplied to dry objects. The refreshing course is intended for the dry objects. Accordingly, when the steam generation is needed, the temperature rise of the drum during driving of the induction heater will become larger. This is because most of moisture to absorb heat has been removed.

Therefore, in the steam step in the drying course or the refreshing course, water spray may be performed during the drum driving S231 and the induction heater driving S232, thereby generating steam S33. Even after steam is generated, driving of the induction heater and the drum may be continued, and then the driving of the drum and the induction heater may be stopped after a predetermined time (S234).

That is, in the drying course or the refreshing course, steam generation and steam supply may be performed simultaneously. Therefore, it is not necessary to perform a separate driving control of the drum for steam generation. In other words, the timing of water spray only needs to be determined in a basic drying or refreshing control algorithm.

The steam step may be performed repeatedly. Water spray may be repeatedly performed while the drum and the induction heater are driven. However, as described above, it is not preferable that the driving of the drum and the induction heater lasts for 1 minute or more. This is because the object in contact with the inner circumferential surface of the drum may be overheated.

Therefore, the driving of the drum and the induction heater may be performed for about 20 to 30 seconds, and water may be sprayed at a time of about 13 to 23 seconds to generate steam and allow the steam to flow into the drum.

In particular, the drum motion at the time of steam generation may be a filtration motion. This motion may allow steam to pass through the spread load. Thereby, wrinkle removal and deodorization performance may be improved. Accordingly, when the turn-over acceleration motion or the space-securing motion described above is performed, steam may be generated and supplied to the object.

The steam step may be performed a plurality of times and then terminated. Steam termination determination (S235) may employ the temperature factor or time factor as in the washing process. The steam step may be repeated until a target temperature is reached through the drying temperature sensor 96 or the wash water temperature sensor 95. In addition, the degree of dryness may be calculated based on the difference between the temperatures sensed by the drying temperature sensor 96 and the wash water temperature sensor 95. Then, when a target dryness degree is reached, the steam step may be terminated.

A predetermined amount of steam may be generated by allowing a predetermined amount of water to be supplied. The predetermined amount of water may be supplied based on the water pressure and the supply time of water. Thus, the steam step may be terminated based on a time factor. In refreshing a small amount of objects, a predetermined amount of water may be supplied for a predetermined time to supply a predetermined amount of steam to the objects. In this case, the difficulty of determining the termination time of the steam step may be eliminated.

In the above-described embodiments, wash water heating, heating for object drying and heating for steam generation may all be performed through one induction heater 8. That is, three heaters may be replaced with one heater. Therefore, the manufacturing cost may be reduced, manufacturing may be facilitated, and the control logic may be simplified.

When one induction heater 8 is employed, the induction heater heats the outer circumferential surface of the drum. Thus, the size of the induction heater may be increased to heat a wide area of the drum. Thereby, driving of the induction heater 8 may be a waste of energy in a case where a small amount of water and a narrow range are heated to generate steam. In addition, since water is sprayed onto the outer circumferential surface of the drum to generate steam, hot water is likely to be supplied to the object inside the drum through through-holes in the refreshing process or the drying process instead of the washing process. Such issues may be addressed by properly designing the spray area or the spray angle of the spray nozzle, but it may be difficult to solve the fundamental problem caused by variation in the water pressure. Fortunately, steam may be generated by spraying water while the induction heater 8 and the drum are driven in the drying process or the refreshing process. Since the drum rotates relatively fast rather than staying in the stationary state, water reaching the outer circumferential surface of the drum may be scattered to the inner circumferential surface of the tub by the rotating drum, and therefore the possibility of hot water flowing into the drum may be significantly reduced.

When two induction heaters 8 and 8*a* are employed, one induction heater 8*a* may be dedicated to steam generation. In this case, the steam induction heater 8*a* may be located in front of the upper portion of the front wall of the tub or behind the upper portion of the rear wall. The opposing surface of the drum facing the steam induction heater 8*a* may also be formed at the upper front portion of the front wall of the drum or the upper front portion of the rear wall of the drum. The front and rear wall portions of the drum may have no through-hole or have only a few through-holes. Accordingly, the cases where the sprayed water turns into hot water rather steam and flows into the drum may be significantly reduced.

In addition, the steam induction heater 8*a*, which has a small capacity, may be used instead of the main induction heater 8, which has a large capacity, in generating steam, and therefore energy may be saved.

In the above-described embodiments, the heating surface of the drum is formed on the outer surface of the drum and water is sprayed onto the outer surface of the drum. That is, water is sprayed into the space between the tub and the drum and steam is generated in the space between the tub and the drum. Therefore, the sprayed water may be prevented from directly flowing into the drum, and the steam may easily move in the relatively narrow space between the tub and the drum in the circumferential direction and radial direction. In other words, steam may be evenly introduced into the drum in the circumferential direction of the drum.

As is apparent from the above description, the present disclosure has effects as follows.

In one embodiment of the present disclosure, a laundry machine that may exclude a heating source involving a sheath heater and employ a heating source involving an induction heater to generate steam and supply the generated steam to the laundry inside the drum, and a control method thereof may be provided.

In one embodiment of the present disclosure, a laundry machine capable of minimizing increase in the operating time of the laundry machine due to generation and supply of steam by generating and supplying steam immediately, and a control method thereof may be provided.

In one embodiment of the present disclosure, a laundry machine capable of generating through a large area to evenly supply steam to the laundry inside a drum, and a control method thereof may be provided.

In one embodiment of the present disclosure, a laundry machine for providing high-quality steam by generating steam by spraying water to an outer surface of a heated drum, and a control method thereof may be provided. In addition, a laundry machine capable of preventing hot water other than steam from being supplied into the drum through a structural or drum motion, and a control method thereof may be provided.

In one embodiment of the present disclosure, a laundry machine capable of generating steam in a space between a tub and a drum and supplying the steam into the drum by driving the drum, and a control method thereof may be provided. Accordingly, a connection hose for steam supply may be excluded, and steam generation and supply may be performed substantially simultaneously.

In one embodiment of the present disclosure, a laundry machine that employs one induction heater for wash water heating, object drying and steam generation, and a control method thereof may be provided. Accordingly, manufacturing of the laundry machine may be facilitated and the manufacturing cost may be reduced compared to a case where three heaters or two heaters are employed.

In one embodiment of the present disclosure, a laundry machine which is provided with a small induction heater for steam generation separately from an induction heater for wash water heating and object drying, and a control method thereof may be provided. Accordingly, energy may be saved. In particular, a laundry machine capable of selectively controlling the output powers of two induction heaters through one inverter drive, and a control method thereof may be provided.

In one embodiment of the present disclosure, a laundry machine that varies the time for drum motion and water spray between a steam operation in a washing process and a steam operation in a drying or refreshing process, and a control method thereof may be provided. Accordingly, optimum steam generation and supply may be implemented in each process.

It will be apparent to those skilled in the art that various modifications and variations can be made in the present disclosure without departing from the spirit and scope of the disclosure. Thus, it is intended that the present disclosure cover the modifications and variations of this disclosure provided they come within the scope of the appended claims and their equivalents.

What is claimed is:

1. A method of controlling a laundry machine to dry or refresh an object, wherein the laundry machine includes:

a tub, a drum rotatably arranged in the tub and configured to receive the object, the drum defining a plurality of through-holes at a circumferential surface thereof, an induction heater mounted at an outside of the tub, and a spray nozzle provided at the tub, the method comprising steaming that includes:

rotating the drum;

heating a surface of the drum by activating the induction heater after rotating the drum; and generating steam by spraying, using the spray nozzle, water downward toward the surface of the rotating drum being heated, the steam being introduced into the drum through the plurality of through-holes of the drum.

2. The method of claim 1, wherein spraying water includes spraying water downward toward the surface of the drum at an oblique angle relative to the surface of the drum.

3. The method of claim 1, further comprising stopping the drum and the induction heater after a predetermined time after generating the steam.

4. The method of claim 3, wherein the steaming further comprises determining whether to terminate the steaming, and wherein the method repeats the steaming based on determining that the steaming is not terminated.

5. The method of claim 3, wherein the determining whether to terminate the steaming comprises determining to terminate the steaming based on the steaming having been repeated by a pre-determined number of times.

6. The method of claim 3, wherein the determining whether to terminate the steaming comprises determining to terminate the steaming based on a temperature reaching a target temperature, the temperature being sensed by a drying temperature sensor or a wash water temperature sensor.

7. The method of claim 6, wherein the determining whether to terminate the steaming comprises determining to terminate the steaming based on a degree of dryness reaching a target dryness degree, the degree of dryness being calculated based on difference between temperatures sensed by the drying temperature sensor and the wash water temperature sensor.

8. The method of claim 3, wherein the generating the steam comprises generating steam by spraying a predetermined amount of water, and wherein the determining whether to terminate the steaming comprises determining to terminate the steaming based on the predetermined amount of water being sprayed.

9. The method of claim 1, wherein the steaming is performed during a drying course for removing moisture from the object or a refreshing course for deodorizing the object and reducing winkles thereon.

10. The method of claim 9, wherein the drying course comprises:

drying the object;

determining whether the steaming is included in the drying course;

based on the steaming being included in the drying course, performing the steaming for providing the steam to the object;

additionally drying the object after the steaming; and cooling the object.

11. The method of claim 9, wherein the refreshing course comprises:

preheating for heating the drum before the steaming;

performing the steaming for providing the steam to the object;

drying the object; and cooling the object.

12. The method of claim 1, wherein, during the generating the steam, the drum is rotated as a filtration motion, the filtration motion being configured to make the object contact an inner circumferential surface of the drum by rotating the drum at 70 to 120 RPM.

13. The method of claim 10, wherein, based on the steam being included in the drying course, the steaming is performed at a last stage of the drying course to reduce static electricity and wrinkles on the object.

* * * * *